US011590507B2

(12) United States Patent
Singer et al.

(10) Patent No.: US 11,590,507 B2
(45) Date of Patent: Feb. 28, 2023

(54) REAGENT CARRIERS FOR FLUIDIC SYSTEMS

(71) Applicant: HelixBind, Inc., Boxborough, MA (US)

(72) Inventors: Alon Singer, Concord, MA (US); Ranjit Prakash, Northborough, MA (US); David Steinmiller, Half Moon Bay, CA (US)

(73) Assignee: HelixBind, Inc., Boxborough, MA (US)

( * ) Notice: Subject to any disclaimer, the term of this patent is extended or adjusted under 35 U.S.C. 154(b) by 113 days.

(21) Appl. No.: 17/183,897

(22) Filed: Feb. 24, 2021

(65) Prior Publication Data

US 2021/0260588 A1 Aug. 26, 2021

Related U.S. Application Data

(60) Provisional application No. 62/981,409, filed on Feb. 25, 2020.

(51) Int. Cl.
*B01L 3/00* (2006.01)

(52) U.S. Cl.
CPC ..... *B01L 3/52* (2013.01); *B01L 3/502* (2013.01); *B01L 2200/026* (2013.01); *B01L 2200/06* (2013.01); *B01L 2200/16* (2013.01); *B01L 2300/0848* (2013.01); *B01L 2300/0861* (2013.01)

(58) Field of Classification Search
CPC ..... B01L 3/52; B01L 3/502; B01L 3/5082; B01L 2200/026; B01L 2200/06; B01L 2200/16; B01L 2300/0848; B01L 2300/0861; B01L 2300/0609
See application file for complete search history.

(56) References Cited

U.S. PATENT DOCUMENTS

| | | | |
|---|---|---|---|
| 3,464,800 | A | 9/1969 | Gerarde |
| 4,772,561 | A | 9/1988 | Genshaw |
| 4,780,744 | A | 10/1988 | Porter et al. |
| 4,898,832 | A | 2/1990 | Klose et al. |
| 6,544,474 | B2 | 4/2003 | Douglas |
| 10,730,041 | B2 | 8/2020 | Singer et al. |
| 2004/0087033 | A1 | 5/2004 | Schembri |

(Continued)

FOREIGN PATENT DOCUMENTS

| | | | |
|---|---|---|---|
| AU | 2009299892 | A1 | 4/2010 |
| JP | 2012-150058 | A | 8/2012 |

(Continued)

OTHER PUBLICATIONS

International Search Report and Written Opinion for International Application No. PCT/US2021/019369 dated Jun. 15, 2021.

*Primary Examiner* — Jennifer Wecker
*Assistant Examiner* — Alea N. Martin
(74) *Attorney, Agent, or Firm* — Wolf, Greenfield & Sacks, P.C.

(57) ABSTRACT

Fluidic systems and reagent carriers suitable for storing reagents in a desirable manner are generally provided. In some embodiments, a reagent carrier stores a liquid film comprising a solid reagent and/or stores different reagents in different locations. In some embodiments, a fluidic system comprises a reagent carrier constrained such that it comprises an elongated axis positioned within 30° of a vertical axis of the fluidic reservoir.

16 Claims, 27 Drawing Sheets

(56) References Cited

U.S. PATENT DOCUMENTS

| | | | | |
|---|---|---|---|---|
| 2010/0196999 | A1 | 8/2010 | Bae et al. | |
| 2014/0154688 | A1* | 6/2014 | Jung | C12Q 1/6806 435/6.12 |
| 2017/0259257 | A1 | 9/2017 | Singer et al. | |
| 2020/0391200 | A1 | 12/2020 | Singer et al. | |
| 2021/0017581 | A1 | 1/2021 | Singer et al. | |

FOREIGN PATENT DOCUMENTS

| | | | |
|---|---|---|---|
| JP | 2019-056580 | A | 4/2019 |
| WO | WO 2016/044621 | A1 | 3/2016 |
| WO | WO 2017/160820 | A1 | 9/2017 |
| WO | WO 2018/187206 | A1 | 10/2018 |

* cited by examiner

REAGENT CARRIERS FOR FLUIDIC SYSTEMS

RELATED APPLICATIONS

This application claims priority under 35 U.S.C. § 119(e) to U.S. Provisional Application No. 62/981,409, filed Feb. 25, 2020, and entitled "Reagent Carriers For Fluidic Systems," which is incorporated herein by reference in its entirety.

FIELD

The present invention relates generally to reagent carriers, and, more particularly, to reagent carriers suitable for use with fluidic systems.

BACKGROUND

Fluidic systems may be employed to react a sample with one or more reagents stored therein. However, some methods of reagent storage are not suitable for positioning different reagents at desirable locations with respect to each other. Accordingly, improved reagent carriers and fluidic systems are needed.

SUMMARY

Fluidic systems, reagent carriers, and related methods and articles are generally described.

In some embodiments, a reagent carrier for use in a fluidic system is provided. The reagent carrier comprises a carrier body and a liquid film disposed on at least a portion of the carrier body. The liquid film comprises a solid reagent and the liquid film is substantially free of water.

In some embodiments, a fluidic system is provided. The fluidic system comprises a fluidic reservoir comprising a vertical axis and a reagent carrier positioned in the fluidic reservoir. The reagent carrier comprises a carrier body comprising an elongated portion extending along an elongated axis and one or more protrusions extending from the elongated portion. The fluidic reservoir constrains the reagent carrier such that the elongated axis forms an angle of 300 or less with the vertical axis of the fluidic reservoir.

In some embodiments, a fluidic system comprises a fluidic reservoir and a reagent carrier positioned in the fluidic reservoir. The reagent carrier comprises a carrier body comprising a first well and a second well. The fluidic system further comprises a first film comprising a first reagent disposed in at least a portion of the first well and a second film comprising a second reagent disposed in at least a portion of the second well. The second reagent is different from the first reagent.

In some embodiments, a method is provided. The method comprises exposing a reagent carrier positioned in a fluidic reservoir to a liquid. The reagent carrier comprises a carrier body comprising a well. A film comprising a reagent is disposed in at least a portion of the well. The method further comprises dissolving and/or suspending at least a portion of the film comprising the reagent in the liquid.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1:
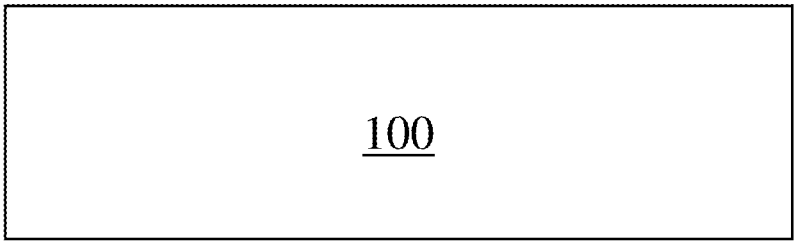
FIG. 1 shows a reagent carrier comprising a carrier body, in accordance with some embodiments.

Fluidic systems, reagent carriers, and related methods and articles are generally described. Some embodiments relate to reagent carriers particularly suitable for use in the fluidic systems described herein, some embodiments relate to fluidic systems comprising a reagent carrier described herein, and some methods relate to uses of the fluidic systems and/or reagent carriers described herein. The reagent carriers described herein may be particularly advantageous for storing reagents in a manner that promotes their introduction to a fluid (e.g., a liquid) in a fluidic system in a manner that is particularly desirable and/or may be configured to interact with a fluidic system in a manner that promotes such introduction. Further advantages associated with exemplary fluidic systems, reagent carriers, and methods are described below.

In some embodiments, a reagent carrier comprises a reagent stored therein that, when exposed to a fluid (e.g., a liquid), dissolves and/or suspends in that fluid in a desirable manner. By way of example, a reagent carrier may store a reagent in a film that, as a whole, is a liquid. Upon exposure of the liquid to a fluid (e.g., to another liquid), the reagent therein may dissolve and/or form a suspension in the fluid in a relatively uniform manner. For instance, the reagent may dissolve and/or be suspended into the fluid relatively homogenously and/or in a manner such that the fluid comprising the dissolved and/or suspended reagent lacks an appreciable number of aggregates of the reagent. Without wishing to be bound by any particular theory, it is believed that aggregates of a reagent may undesirably reduce the surface area of the reagent available for engaging in any particular reactions, which may disadvantageously slow the rate and/or limit the extent of any reactions that the reagent is configured to take part in. It is believed that the liquid nature of the film may assist with this dissolution and/or suspension. Advantageously, the liquid film may have a combination of viscosity and surface tension sufficient to retain the reagent, which may be in a liquid or in a form other than a liquid (e.g., a solid), in a location at which the fluidic device is configured to introduce the reagent to a fluid prior to exposure thereto.

As another example of an advantageous design contemplated herein, a reagent carrier may comprise two different reagents and/or two different combinations of reagents that are not in direct topological contact with each other at one or more points in time (e.g., during storage, prior to the exposure of the combination of reagents to a common liquid, at any point in time). Advantageously, topological separation of reagents from each other may allow incompatible reagents (e.g., reagents reactive with each other) to be stored in close proximity to each other, to be introduced into the reagent carrier at close points in time to each other, and/or to undergo processing steps together. Additionally, topological separation of reagents from each other may allow for exposure of a fluid (e.g., a liquid) in the fluidic system to one set of reagents but not another. This may facilitate the performance of reactions in the fluid involving one reagent but not the other and/or exposure of the fluid to the different reagents in a desired sequence and/or at desired points in time.

In some embodiments, topological separation of reagents is effected by a reagent carrier that comprises two or more wells, at least two of which comprise or contain a different reagent and/or combination of reagents from each other. The presence of wells in the reagent carrier may facilitate this lack of topological contact, as each well may enclose and serve to topologically isolate the reagent(s) disposed therein (and/or any fluids disposed therein, such as liquids and/or fluids from the reagent(s) were cast) from the contents of the other well. However, it should be understood that it is also possible for reagents and/or combinations of reagents to be kept out of physical contact with each other in a manner other than being positioned in separate wells. For instance, in some embodiments, two or more reagents and/or combinations of reagents are positioned in different films that are prevented from merging due to their relatively high viscosities and/or surface tensions.

As a third example of an advantageous design contemplated herein, a fluidic system may constrain the position of a reagent carrier therein. The position(s) to which the reagent carrier is constrained may be that or those particularly advantageous for one or more desired uses of the fluidic system. By way of example, in some embodiments, a fluidic system constrains the reagent carrier such that it is oriented relatively vertically in a fluidic reservoir therein and/or such that there is vertical separation between two or more wells therein. This positioning of the reagent carrier may allow the reagent(s) to which a fluid in the fluidic system is exposed to be controlled by controlling the volume of the fluid introduced into the fluidic system. Introducing smaller volumes of fluid into the fluidic system may expose the fluid to only those reagents positioned in a lower portion of the reagent carrier, while introducing larger volumes of fluid into the fluidic system may expose the fluid to reagents positioned in both lower and upper portions of the reagent carrier. Control over the reagents to which a fluid is exposed may be desirable for the reasons described above.

Figure 2:
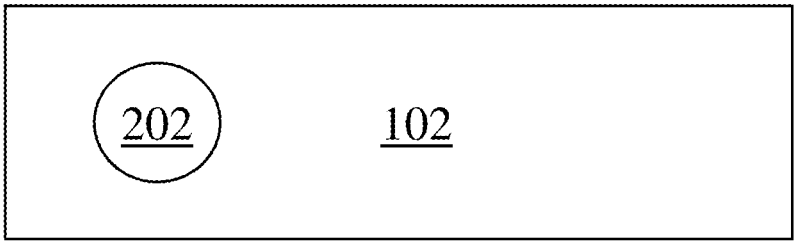
FIG. 2 shows a top view of a reagent carrier comprising a carrier body comprising a well, in accordance with some embodiments.
Figure 3:
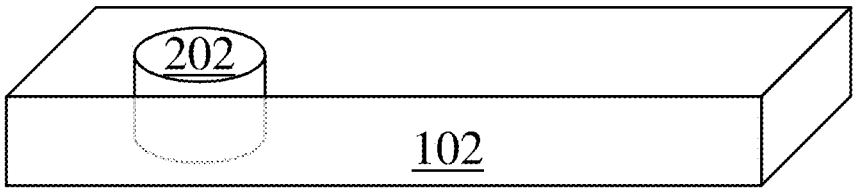
FIG. 3 shows a perspective view of the reagent carrier depicted in FIG. 2, in accordance with some embodiments.
Figure 4:
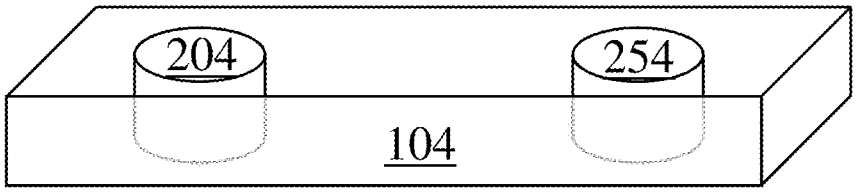
FIG. 4 shows a perspective view of a reagent carrier comprising a carrier body comprising two wells, in accordance with some embodiments.

FIG. 1 shows one non-limiting embodiment of a reagent carrier comprising a carrier body 100. As shown in FIGS. 2-4, some reagents carriers comprise one or more wells. A well may take the form of a recess and/or depression in an external surface of the carrier body. By way of example, FIG. 2 shows a top view of a reagent carrier comprising a carrier body 102 comprising a well 202, FIG. 3 shows a perspective view of this same reagent carrier, and FIG. 4 shows a perspective view of a reagent carrier comprising a carrier body 104 comprising two wells 204 and 254. Some wells may be surrounded on all sides by portion(s) of the carrier body (e.g., they may be present in a single external surface, as is shown in FIGS. 3-4), and some wells may intersect with two or more external surfaces of the carrier body (e.g., they may take the form of a recess and/or depression in two or more external surfaces of the carrier body). It should be understood that FIGS. 1-4 are exemplary, and that reagent carriers having both similarities and differences to those shown in FIGS. 1-4 are contemplated.

Figure 5:
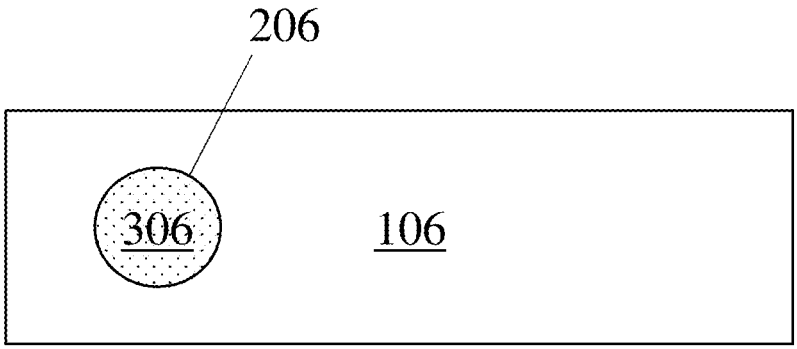
FIG. 5 shows a reagent carrier in which a film comprising one or more reagents is disposed within a well positioned in the reagent carrier's carrier body, in accordance with some embodiments.

In some embodiments, one or more reagents are disposed in a well of a reagent carrier. For instance, a film comprising one or more reagents may be disposed therein. FIG. 5 schematically depicts a reagent carrier having this property. In FIG. 5, a film 306 comprising one or more reagents is disposed within a well 206 positioned in a carrier body 106. Films disposed in wells of reagent carriers may have a variety of suitable morphologies. For instance, the films may be continuous or discontinuous. In some embodiments, a film comprising one or more reagents may conformally coat the interior of the well (e.g., including any sidewalls thereof), and in some embodiments a film comprising one or more reagents may fill the well to a constant depth. Films coating wells may be smooth or rough, uniform or nonuniform, and porous or nonporous.

Components disposed on and/or in each other as described herein and/or shown in the figures herein may be directly disposed on and/or in each other or may be indirectly disposed on and/or in each other. In other words, as used herein, when a component is referred to as being "disposed on", "disposed in", or "adjacent" another component, it can be directly disposed on, in, or adjacent the component, or it may be disposed on or in one or more intervening components disposed on or in the other component. A component that is "directly disposed on", "directly disposed in", "directly adjacent" or "in contact with" another component is disposed on the other component in a manner such that no intervening component is present.

As another example of a manner in which one or more reagents may be disposed in a well of a reagent carrier, in some embodiments, one or more reagents in the form of a pellet are disposed in a well of a reagent carrier. The reagent carrier may be configured to contain the pellet therein. In some embodiments, a well configured to contain a pellet therein is also configured to hold the pellet therein. For instance, the well may be configured to hold the pellet therein by frictional forces and/or by an adhesive. The frictional forces, adhesive, and/or other design configured to retain a pellet in a well may take the form of a portion configured to retain the pellet in the well. As an example, frictional forces may be applied by a component of the reagent carrier other than the well (e.g., in addition to any frictional forces applied to the pellet by the well). By way of example, in some embodiments, a reagent carrier comprises a flap that is configured to, optionally in combination with one or more surfaces of the well, apply frictional forces to a pellet disposed in a well. For instance, the flap, optionally in combination with one or more surfaces of the well, may be configured to clamp the pellet in the well. In some embodiments, a pellet disposed in a well is configured to be, and/or is, in fluidic communication with a fluidic reservoir in which the reagent carrier comprising the well is positioned. This fluidic communication may occur, and/or be configured to occur, even when a flap applying frictional forces to the pellet is in the closed state.

When present, a flap may be configured to be movable at one or more points in time. For instance, the flap may be configured to be movable from an "open" state, in which the pellet can be easily inserted into the well, to a "closed" state, in which the flap applies frictional forces to the pellet to contain it in the well. The flap may be configured to be closed once (i.e., to be moved from an initial open state to a closed state, but not to be moved back to the open state) or to be reversibly opened and closed. In some embodiments, a reagent carrier comprising a flap further comprises one or more clasps configured to hold the flap in the closed state. Such clasps may be engaged by pressing down the flap.

For some reagent carriers comprising a flap, the entirety of the reagent carrier may be formed of a single unitary material. It is also possible for one or more components of the reagent carrier (e.g., the flap) may be formed as a separate part from the rest of the reagent carrier. In either case, the material forming the flap should be sufficiently flexible such that the flap can be closed (e.g., by folding around the well in which it is configured to assist with the containment of a pellet).

Figure 6:
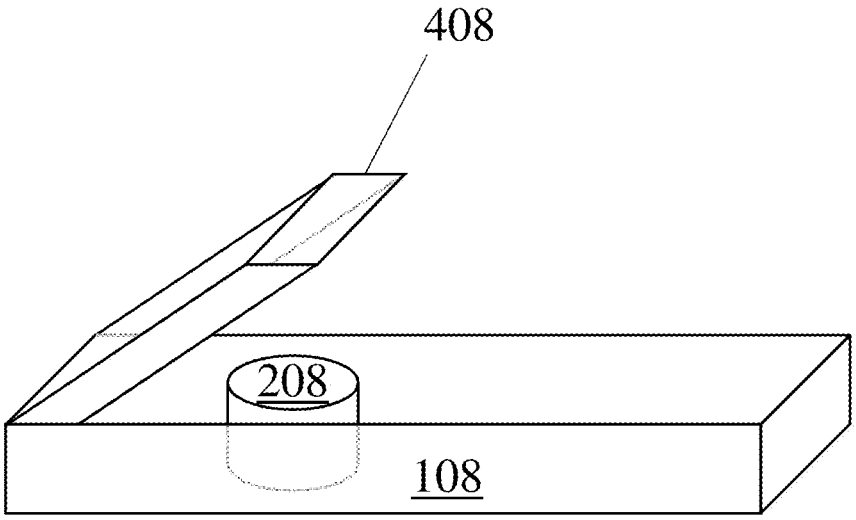
FIG. 6 shows a reagent carrier configured to hold a pellet by frictional forces, in accordance with some embodiments.

FIG. 6 shows one non-limiting embodiment of a reagent carrier configured to hold a pellet by frictional forces. In FIG. 6, the reagent carrier comprises a carrier body 108 comprising a well 208 and further comprising a flap 408. In FIG. 6, the flap 408 is in the open position.

It should also be noted that reagent carriers comprising two or more wells may comprise one or more wells in which one or more reagents are disposed and/or may comprise one or more wells lacking any reagents. In embodiments in which a reagent carrier comprises two or more wells that each comprise one or more reagents, such reagents (or combinations of reagents) may be the same or may differ in one or more ways (e.g., two wells may each comprise a set of reagents including some common reagents and some reagents different from those in the other well). Similarly, in such embodiments, the form the reagents take in the wells may be the same or may differ in one or more ways (e.g., they may be positioned in films having different morphologies).

Wells lacking reagents may be empty (e.g., they may comprise and/or contain any fluid also present in an environment, such as a fluidic reservoir, in which the reagent carrier is positioned) or may comprise a component other than a reagent (e.g., a component from which a reagent has been released). It is also possible for a well to initially comprise a reagent but to become free of the reagent (e.g., empty) during use of a fluidic device in which a reagent carrier comprising the well is positioned. By way of example, and as described elsewhere herein, in some embodiments, a well initially comprises one or more reagents that are released (e.g., fully) into a liquid to which they are exposed during a method performed in the fluidic device. After the performance of the relevant method, the well may lack the reagent (and, possibly all species) that it initially comprised.

Additionally, it should be noted that some reagent carriers may comprise reagents located in positions other than disposed on and/or contained within wells. By way of example, in some embodiments, a reagent carrier comprises a film comprising a reagent disposed thereon in a location other than on a well therein, such as on a portion of a carrier body other than a well therein.

Figure 7:
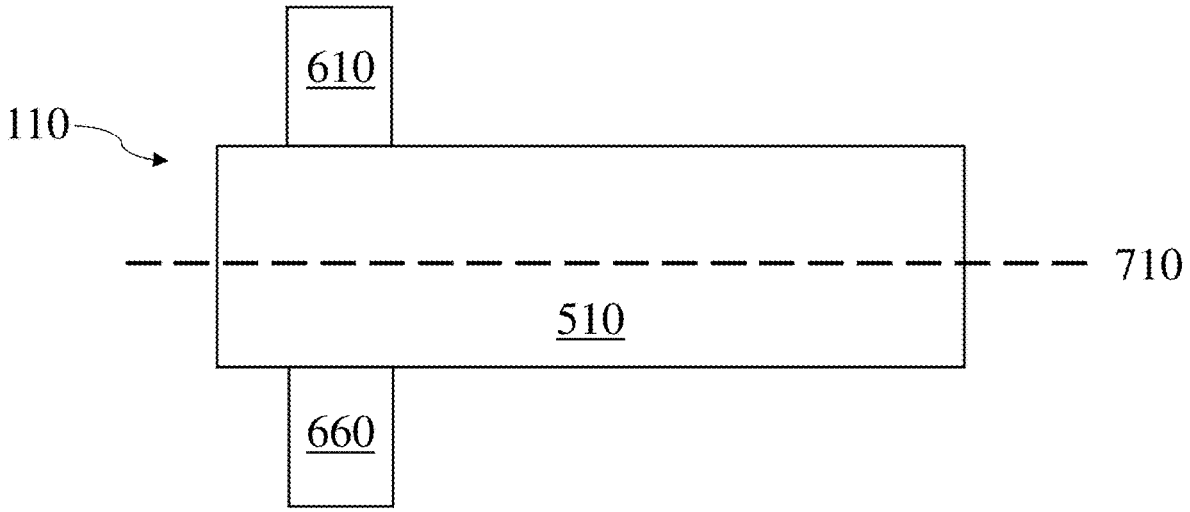
FIGS. 7 and 8A-8H show reagent carriers comprising a carrier body comprising an elongated portion and two protrusions, in accordance with some embodiments.

As described elsewhere herein, some reagent carriers described herein have designs configured to interact with a fluidic system in a desirable manner. By way of example, a reagent carrier may comprise one or more portions configured to assist the positioning of the reagent carrier in the fluidic system in an advantageous location and/or at an advantageous orientation. FIG. 7 shows one example of a reagent carrier having such a design. The reagent carrier shown in FIG. 7 comprises a carrier body 110 comprising an elongated portion 510 and two protrusions 610 and 660. The elongated portion 510 shown in FIG. 7 extends along an elongated axis 710. As shown in FIG. 7, an elongated axis along which an elongated portion extends may be the longest principal axis of the elongated portion. Some reagent carriers may comprise an elongated portion that is positioned symmetrically about the elongated axis. By way of example, the elongated axis may be an axis around which the elongated portion is rotationally symmetric and/or may be an axis through which a mirror plane for the elongated portion passes.

Protrusions like those shown in FIG. 7 may increase the width of the reagent carrier, which may restrict the locations within the fluidic system into which it will fit, restrict the orientations within one or more locations within the fluidic system in which it may be positioned, and/or restrict its mobility in the fluidic system once positioned. In some embodiments, such protrusions may do so without appreciably reducing and/or hindering the flow of liquids within one or more locations of the fluidic system (e.g., around the reagent carrier, in the well in which the reagent carrier is disposed). As reduced and/or hindered flow in the vicinity of the reagents in the reagent carrier is believed to hinder dissolution and/or suspension of the reagents, this feature is believed to be advantageous.

FIGS. 8A-8H show further possible reagent carrier designs in which the reagent carrier comprises two protrusions and an elongated portion. When a reagent carrier comprises two or more protrusions, it may comprise protrusions that are identical to each other (e.g., like the protrusions shown in FIGS. 7 and 8A-8H), and/or protrusions that differ from other protrusions in one or more ways. By way of example, a reagent carrier may comprise protrusions differing in size, shape, or any other feature. Similarly, some reagent carriers comprise two or more protrusions that are positioned such that their centroids are equidistant from a portion of the reagent carrier (e.g., from one end of an elongated portion therein) and/or comprise two or more portions that are not positioned such that their centroids are equidistant to that portion of the reagent carrier.

Some reagent carriers comprise two or more protrusions that are positioned in a symmetrical manner and some reagent carriers may comprise two or more protrusions that are not positioned in a symmetrical manner. In other words, some reagent carriers may comprise two or more protrusions that are positioned in a manner invariant under one or more symmetry operations. The symmetry operations may include reflection (e.g., the protrusions may be positioned such that a mirror plane exists) and/or rotation (e.g., the protrusions may be positioned such that they have radial symmetry around an axis and/or a point). In some embodiments, two or more protrusions are positioned such that a plane, axis, or point around which they are symmetrically positioned is positioned on and/or passes through a portion of the reagent carrier. By way of example, some protrusions may have mirror symmetry across a mirror plane that passes through an elongated portion of the reagent carrier (e.g., through its center) and/or may have rotational symmetry around an axis that passes through an elongated portion of the reagent carrier (e.g., an axis along which the elongated portion extends).

Figure 8A:
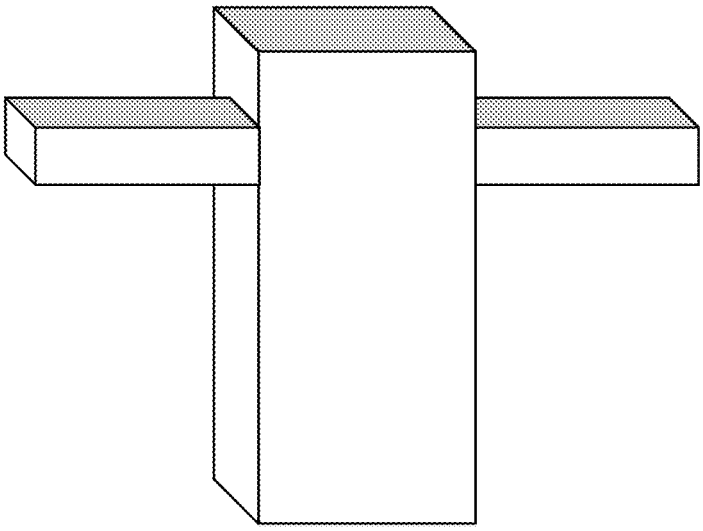
Figure 8B:
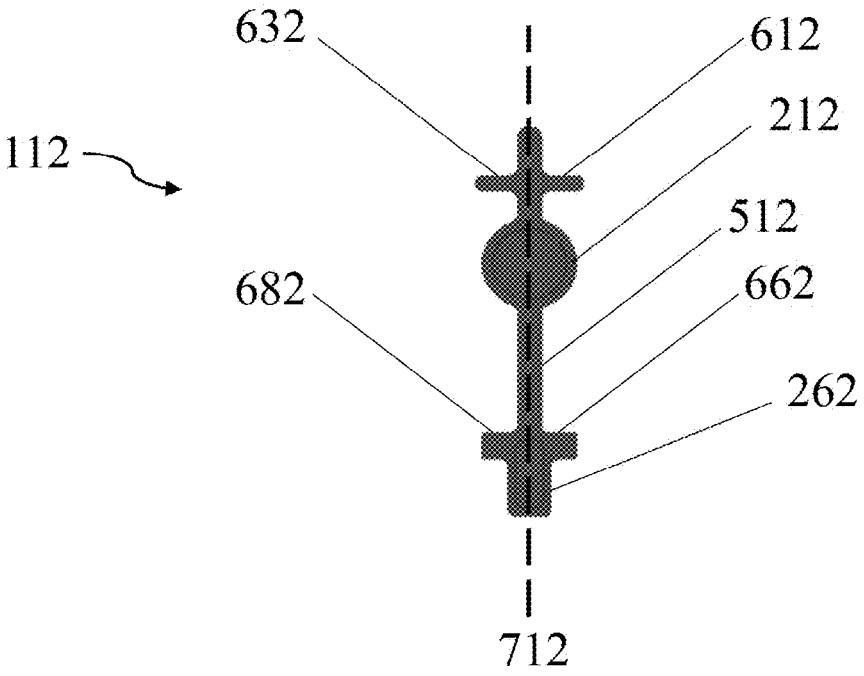
Figure 8C:
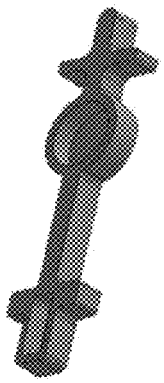

In some embodiments, a reagent carrier comprises two or more sets of protrusions, and each set has one or more of the above-referenced features. For instance, a reagent carrier may comprise one set of protrusions that all have an identical shape and are all positioned in a symmetrical manner around a first axis of rotation and may comprise a second set of protrusions that all have a different identical shape and are all positioned in a symmetrical manner around a second axis of rotation. FIGS. 8B-8C show two views of a reagent carrier having this property. With reference to FIG. 8B, the reagent carrier depicted therein comprises a carrier body 112 that includes two wells 212 and 262, a first set of protrusions 612 and 632, and a second set of protrusions 662 and 682. Both the first set of protrusions and the second set of protrusions are positioned symmetrically around an axis 712 passing through the center of the elongated portion 512 of the carrier body and are also positioned with mirror symmetry across this axis. Additionally, the protrusions 612 and 632 in the first set of protrusions both have the same shape and size and are both positioned such that their centroids are equidistant from the axis 712 passing through the elongated portion (i.e., along which the elongated portion extends). Similarly, the protrusions 662 and 682 in the second set of protrusions both have the same shape and size and are both positioned such that their centroids are equidistant the axis 712 passing through the elongated portion (i.e., along which the elongated portion extends). However, the first set of protrusions 612 and 632 are shaped differently than and have different sizes than the second set of protrusions 662 and 682. Similarly, the first set of protrusions 612 and 632 and the second set of protrusions 662 and 682 are not together positioned in a symmetrical manner or all positioned equidistant to any portion of the carrier body.

Figure 8D:
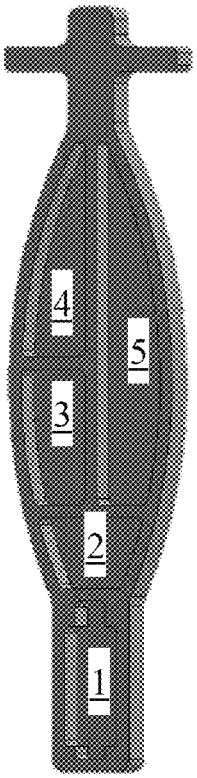
Figure 8E:
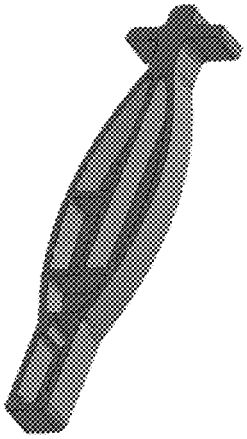
Figure 8F:
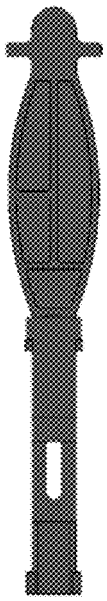
Figure 8G:
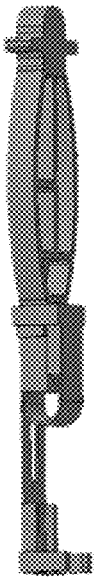
Figure 8H:
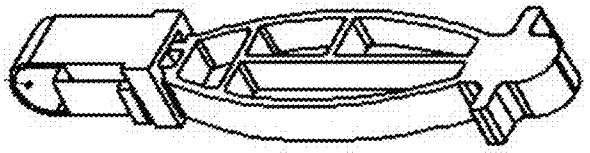

As shown in FIGS. 8B-8H, reagent carriers comprising one or more protrusions and an elongated portion may further comprise one or more wells disposed in the elongated portion. By way of example, and as described above with respect to FIG. 8B, FIGS. 8B-8H each depict a reagent carrier comprising at least two wells and at least two protrusions. It should also be noted that FIGS. 8F-8H depict exemplary embodiments of reagent carriers comprising wells, protrusions, and a flap.

In some embodiments, a reagent carrier is configured to be positioned in one or more components of a fluidic system. By way of example, some reagent carriers may be configured to be positioned in fluidic reservoirs. It is also possible for some fluidic reservoirs to contain reagent carriers. A fluidic reservoir may be a portion of the fluidic device that is configured to, at one or more points in time, comprise a fluid (e.g., a liquid, a gas, a liquid at some points in time and a gas at others, a liquid and a gas at the same time). For instance, a fluidic reservoir may be configured to initially comprise the fluid (e.g., the fluidic device may be provided to a user thereof in a state in which the fluidic reservoir comprises the fluid) and/or may initially lack the fluid but be configured to comprise the fluid at a later point in time (e.g., during use of the fluidic device to analyze a sample, during preparation of the fluidic device for sample analysis, and/or after sample analysis). Some fluidic reservoirs may be configured to comprise a fluid at some points in time but not at other, later points in time. For instance, the fluidic device may be provided to a user thereof in a state in which the fluidic reservoir comprises a fluid that is transported into a different portion of the fluidic device during later (e.g., during preparation of the fluidic device for sample analysis, during sample analysis, after sample analysis). As another example, the fluidic reservoir may be configured such that a fluid passes through it, is transferred to it, and/or is contained by it during one or more processes (e.g., during preparation of the fluidic device for sample analysis, during sample analysis, after sample analysis), but which is not retained in the fluidic reservoir after the conclusion of the relevant process. It is also noted that some fluidic reservoirs may be configured to comprise two or more different fluids (e.g., at different points in time, at the same time).

In some embodiments, and as also described elsewhere herein, a reagent carrier is configured to interact with a fluidic system, and/or one or more components thereof, in a manner such that it is constrained to be positioned at a desirable orientation and/or location therein. For instance, a reagent carrier may be configured to interact with a portion of the fluidic system in which it is positioned, such as a fluidic reservoir, in this manner. The interaction may be one other than constraint due to attachment of the reagent carrier to the portion of the fluidic system (e.g., to the fluidic reservoir). In other words, in some embodiments, a reagent carrier is not integrally connected to a portion of the fluidic system (e.g., the fluidic reservoir) or not integrally connected to the fluidic system but is still constrained by the portion of the fluidic system. In some embodiments, a reagent carrier may be fully separable from a portion of a fluidic system (e.g., a fluidic reservoir) and/or the fluidic system as a whole yet still be constrained by the portion of the fluidic system.

Figure 9A:
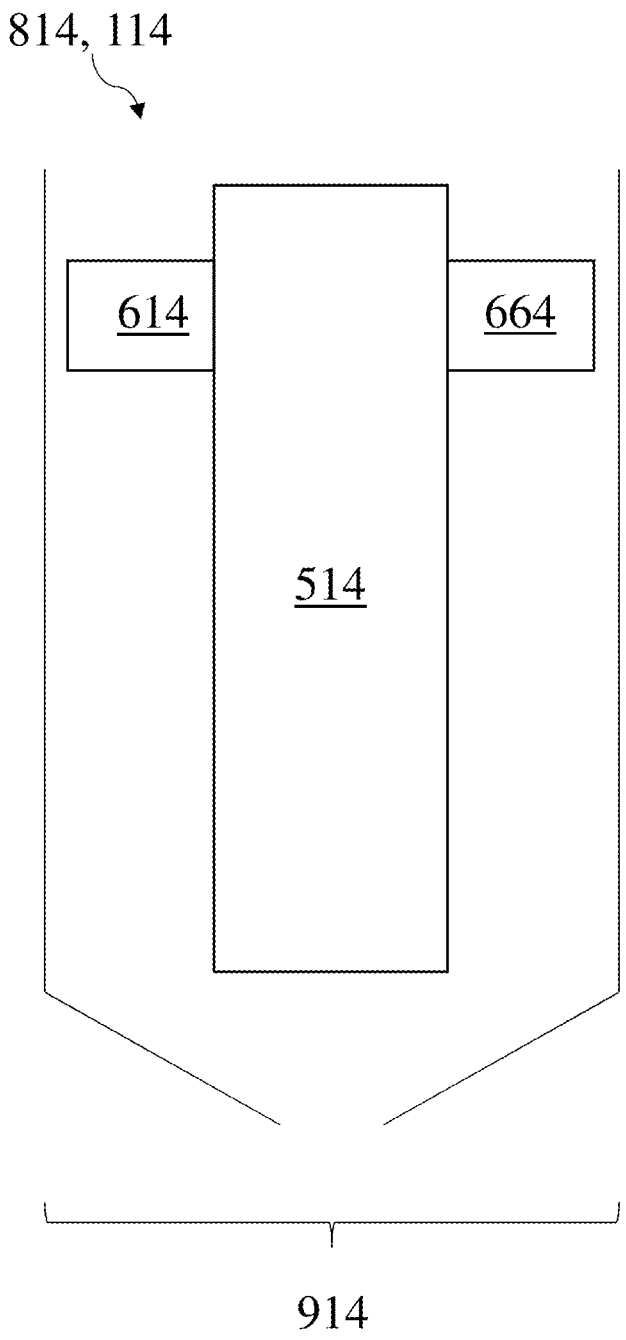
FIGS. 9A-9C shows reagent carriers and fluidic reservoirs constraining the orientation of the reagent carriers, in accordance with some embodiments.
Figure 9B:
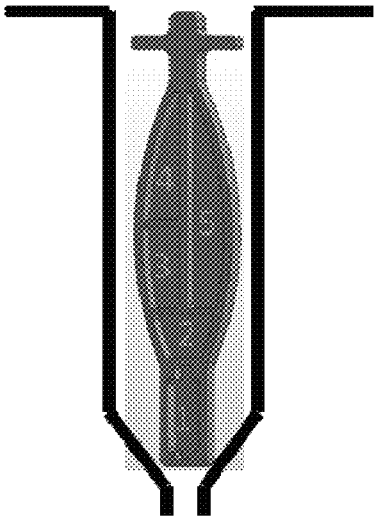

As one example, the reagent carrier may have a shape such that, when positioned at an initial orientation in a fluidic reservoir, prevents the reagent carrier from adopting a subsequent undesirable orientation. This may be accomplished by selecting the morphology of the reagent carrier and the fluidic reservoir in which it is configured to be positioned together such that the fluidic reservoir constrains the reagent carrier to a set of desirable orientations. FIG. 9A shows one example of a pair of a reagent carrier and fluidic reservoir for which the fluidic reservoir constrains the orientation of the reagent carrier. In FIG. 9A, the reagent carrier 814 comprises a carrier body 114 comprising an elongated portion 514 and two protrusions 614 and 664. It is positioned inside a fluidic reservoir 914. As can be seen from FIG. 9A, the protrusions 614 and 664 of the reagent carrier 814 prevent the reagent carrier from tilting over into a position that appreciably deviates from its initial upright position. FIG. 9B shows another example of a combination of a fluidic reservoir and a reagent carrier positioned therein for which the fluidic reservoir constrains the reagent carrier to adopt a set of advantageous orientations. Like the reagent carrier shown in FIG. 9B, reagent carriers constrained and/or configured to be constrained by a fluidic reservoir may comprise one or more wells (e.g., two or more wells, three or more wells, four or more wells, five or more wells, or more wells).

Figure 9C:
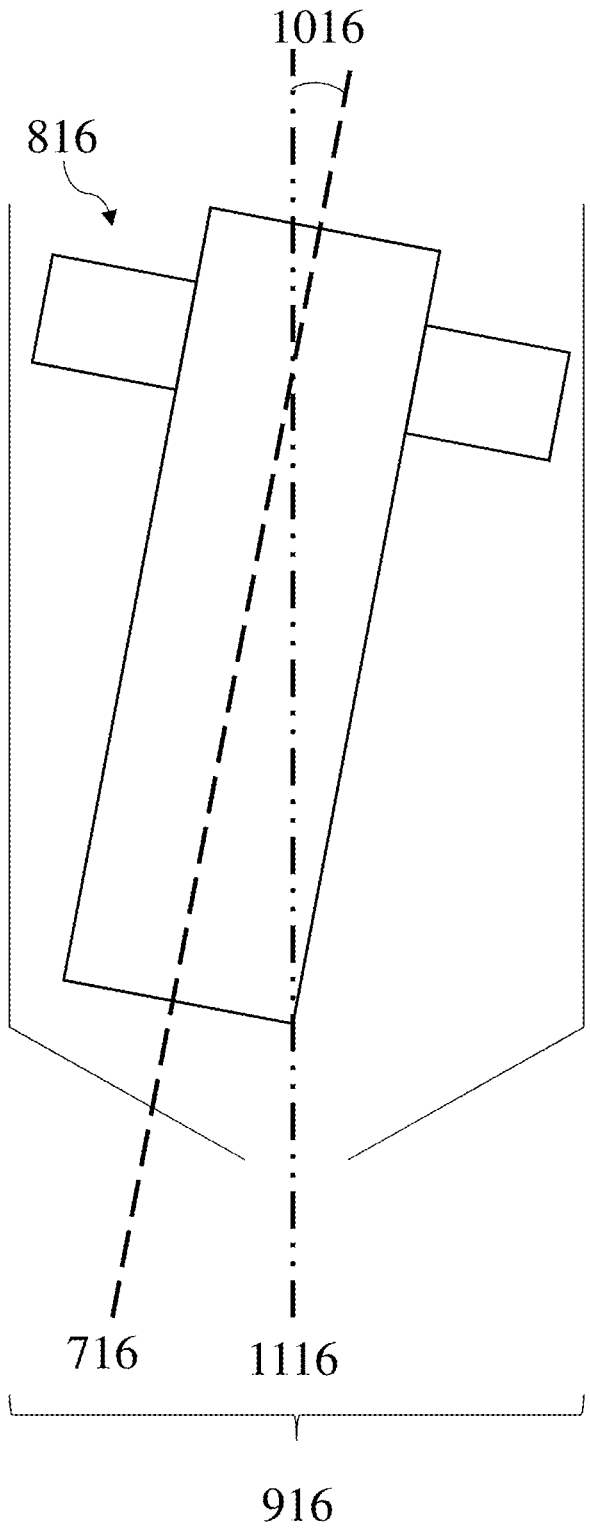

One way in which the degree to which a fluidic reservoir constrains a reagent carrier may be quantified is by the range of angles that the fluidic reservoir allows an elongated axis along which an elongated portion of the reagent carrier extends to take with respect to the vertical axis thereof. The vertical axis of the fluidic reservoir may be an axis passing through the fluidic reservoir that is oriented along the direction of gravity. Characterizing the position of a reagent carrier with respect to a vertical axis of a fluidic reservoir in which it is positioned may be particularly appropriate in embodiments in which it is desirable for an elongated portion of the reagent carrier to extend in a relatively vertical direction, such as when the elongated portion comprises two or more wells positioned at different locations along the elongated axis therein and for which it would be beneficial to introduce into a fluid positioned in the fluidic system at different points in time. When the fluidic reservoir restricts the elongated axis of a reagent carrier positioned therein to a range of angles with its vertical axis, it, accordingly, may restrict the vertical separation between wells positioned at different locations along the elongated axis. For a fluidic reservoir of fixed shape, this may allow for wells to be first exposed to a fluid introduced into the fluidic reservoir (e.g., a liquid, a gas) at a volume of the fluid that is restricted to a certain range (e.g., it may prevent one or more wells from being exposed to a fluid introduced into the fluidic reservoir until that fluid is present at a volume in excess of a certain minimum amount and/or ensure that the well(s) will be exposed to a fluid introduced into the fluidic reservoir once the fluid is present at a volume in excess of a different minimum amount). With reference to FIG. 9C, the fluidic reservoir 916 in which the reagent carrier 816 is positioned may constrain the reagent carrier such that its elongated axis 716 forms an angle 1016 with the vertical axis 1116 of the fluidic reservoir within a certain range.

It should also be understood that some reagent carriers may be constrained by one or more features of a fluidic reservoir (e.g., in addition to any portions of the reagent carrier that prevent it from adopting one or more orientations in the fluidic reservoir, instead of portions of the reagent carrier that prevent it from adopting one or more orientations in the fluidic reservoir). By way of example, in some embodiments, a fluidic reservoir comprises one or more grooves and/or protrusions therein that constrain the orientation of a reagent carrier positioned therein. As another example, in some embodiments, a reagent carrier is integrally connected to one or more portions of the fluidic system (e.g., the fluidic reservoirs in which it is positioned, the fluidic system as a whole) and/or is not separable from one or more portions of the fluidic system (e.g., the fluidic reservoirs in which it is positioned, the fluidic system as a whole). It is also possible for a fluidic reservoir to be unconstrained by any portion of a fluidic system in which they are positioned and/or configured to be positioned.

In some embodiments, a fluidic system comprises a fluidic reservoir and further comprises one or more additional components configured to introduce a fluid (e.g., a liquid, a gas) into the fluidic reservoir. By way of example, in some embodiments, a fluidic system comprises a fluidic reservoir and further comprises a fluidic channel in fluidic communication (and/or configured to be placed in fluidic communication) therewith. A fluid introduced into the fluidic channel may, when the fluidic reservoir is in fluidic communication therewith and sufficient pressure is applied thereto, flow into the fluidic reservoir. In some embodiments, it may be advantageous for the fluidic channel to be positioned with respect to the fluidic reservoir such that the fluidic reservoir is filled from the bottom up and/or from a location beneath that of any reagents configured to be solubilized by the fluid. This may be beneficial when it is desirable to expose the reagent carrier to fluid in a controlled and predictable manner. Fluid entering the fluidic reservoir from the bottom up may fill the fluidic reservoir until the pressure exerted thereby is equivalent to the pressure applied to the fluid, and so the amount of fluid in the fluidic reservoir and portions of the fluidic reservoir (and any reagent carrier therein) may be facilely controlled. By contrast, fluid entering the fluidic reservoir from another location in the fluidic reservoir may flow downwards therein under the influence of gravity and/or laterally therein under the influence of forces of forces of relatively small magnitude, and so may be exposed to portions of the fluidic reservoir (and/or a reagent carrier therein) in a manner that is inconsistent, unpredictable, and/or challenging to control. In some embodiments, fluid may enter the fluidic reservoir in a laminar manner, which may promote the filling of the fluidic reservoir in a controlled and/or predictable manner.

Figure 10:
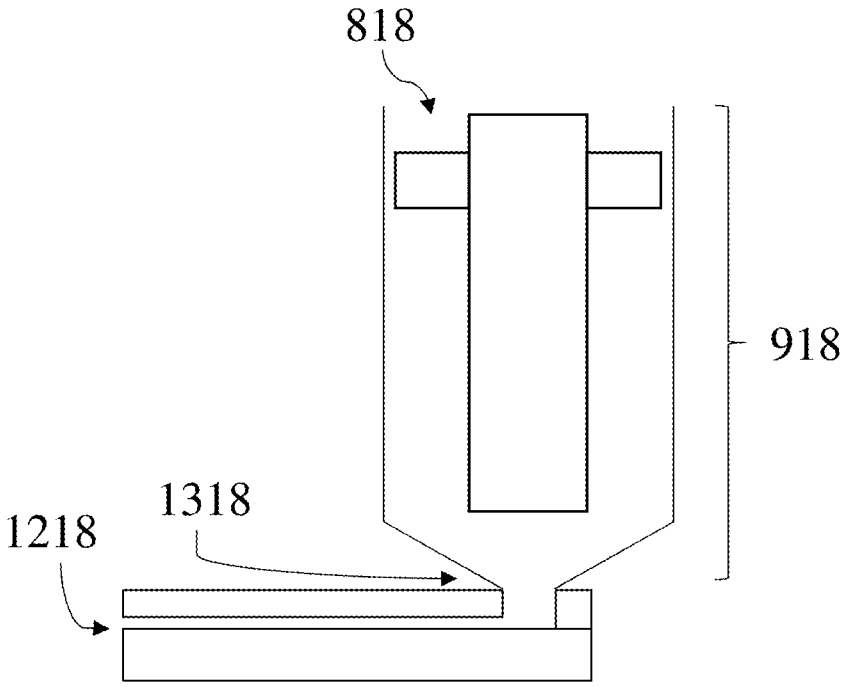
FIG. 10 shows a fluidic system comprising a fluidic channel and a fluidic reservoir in which a reagent carrier is positioned, in accordance with some embodiments.

FIG. 10 shows one example of a fluidic system comprising a fluidic channel 1218 and a fluidic reservoir 918 in which a reagent carrier 818 is positioned. The fluidic channel 1218 is in fluidic communication with the base 1318 of the fluidic reservoir 918, and is configured to fill the fluidic reservoir 918 therefrom. In some embodiments, a valve is positioned between a fluidic reservoir and a fluidic channel configured to introduce fluid thereinto. By way of example, with reference to FIG. 10, a valve may be positioned between the fluidic reservoir 918 and the fluidic channel 1218 that, when open, places the fluidic reservoir 918 and the fluidic channel 1218 in fluidic communication but, when closed, removes the fluidic reservoir 918 from fluidic communication with the fluidic channel 1218. It is also possible for a valve to be positioned between a fluidic channel and another component of the fluidic system. For instance, with reference to FIG. 10, a valve may be positioned at a location that reversibly places the fluidic channel 1218 in fluidic communication with one or more components of the fluidic system upstream of the fluidic channel 1218. Suitable valves may be configured to be reversibly opened and closed, irreversibly opened, and/or irreversibly closed. Some valves may be configured to allow fluid to flow therethrough in one direction only when open (e.g., they may be check valves), may be configured to allow fluid to flow therethrough in two or more directions when open, and/or may be configured to allow fluid flow therethrough in a subset of possible directions (e.g., they may be three-way valves).

In some embodiments, a fluidic system comprises one or more fluidic channels that terminate with a fluidic reservoir. With reference to FIG. 10, the fluidic channel 1218 terminates with the fluidic reservoir 918.

Figure 11A:
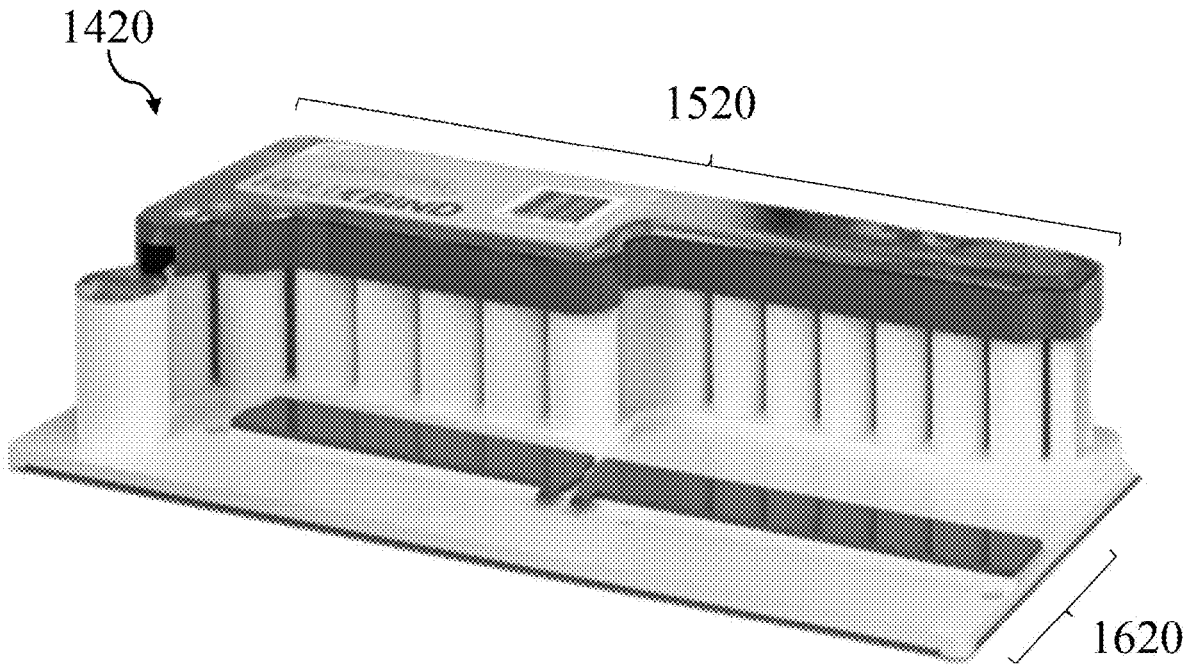
FIGS. 11A-11B show two different views of a fluidic system, in accordance with some embodiments.
Figure 11B:
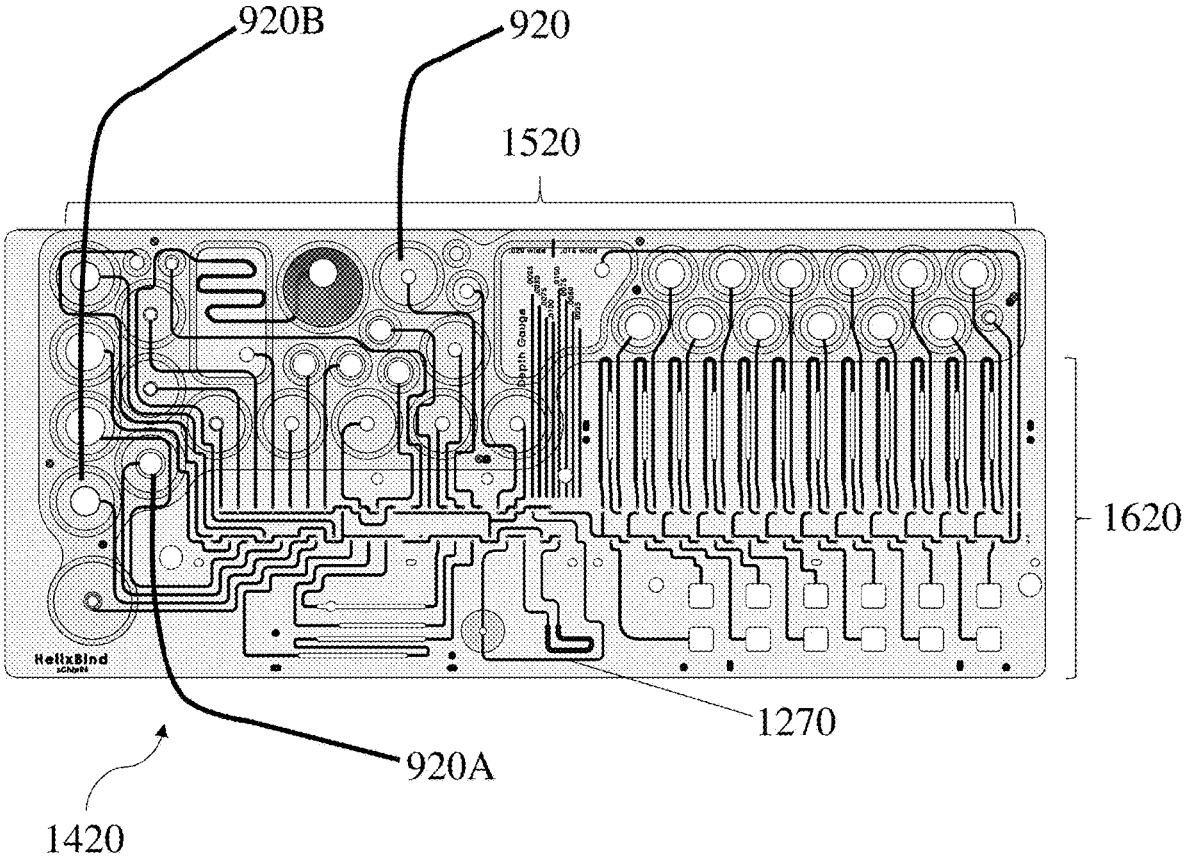
Figure 12A:
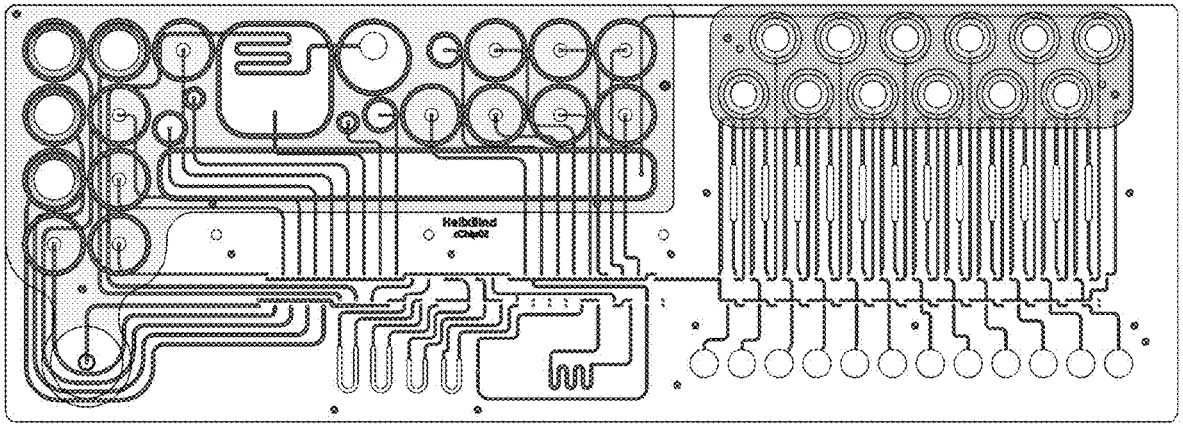
FIGS. 12A-12B show top-down views of cross-sections of two examples of fluidic systems, in accordance with some embodiments.
Figure 12B:
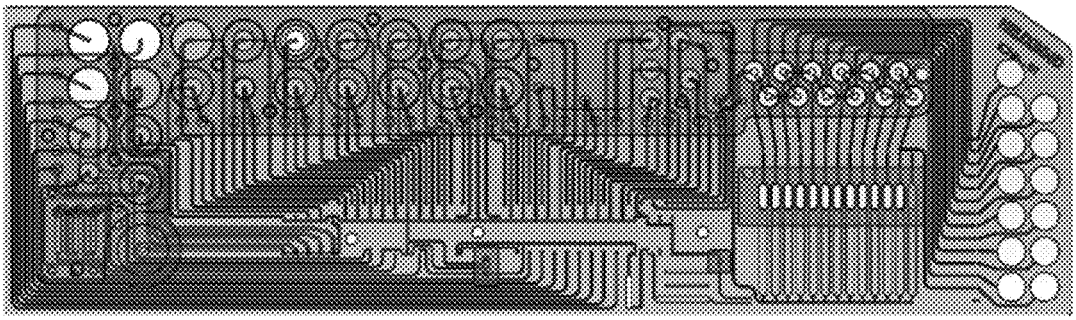

Some suitable fluidic systems (e.g., fluidic systems comprising a reagent carrier and/or in which a reagent carrier is configured to be positioned) may comprise a plurality of fluidic reservoirs, fluidic channels, and/or reagent carriers. FIGS. 11A and 11B show two different views of one non-limiting embodiment of such a fluidic system. FIG. 11A shows a perspective view of the exterior of the fluidic system and FIG. 11B shows a top-down view of its cross-section. In FIGS. 11A and 11B, the fluidic system 1420 comprises a first region 1520 comprising a plurality of fluidic reservoirs and fluidic channels and further comprises other regions (e.g., the region 1620) comprising fluidic channels but lacking fluidic reservoirs. With reference to FIG. 11B, one example of a fluidic reservoir in the first region is the fluidic reservoir 920, and one example of a fluidic channel in the second region is the fluidic channel 1270. FIGS. 12A and 12B show top-down views of cross-sections of two further examples of fluidic systems suitable for use with the reagent carriers described herein. Further details of some exemplary fluidic systems of which the components (e.g., reagent cartridges, fluidic reservoirs, fluidic channels) described herein may form a part and/or with which some of the components described herein may be configured for use are described in further detail in U.S. Patent Publication No. 2017/0259257, incorporated herein by reference in its entirety for all purposes. It should also be understood that the fluidic systems shown in FIGS. 11A, 11B, 12A, and 12B and the fluidic systems descried in U.S. Patent Publication No. 2017/0259257 are purely exemplary and that some embodiments may relate to fluidic systems differing from such fluidic systems in one or more ways.

As one specific example of a design that may be present in a fluidic system, in some embodiments, a fluidic system comprises two or more fluidic reservoirs configured such that a fluid introduced into the fluidic reservoir (e.g., a liquid, a gas) may be configured to pass through the two or more fluidic reservoirs sequentially. For instance, two or more fluidic reservoirs may be placed in fluidic communication by a plurality of channels that is configured to convey a fluid sequentially through the two or more fluidic reservoirs. This may be advantageous in embodiments in which it is desirable to perform multiple sequential reactions on a fluid. Each of, or a subset of, the fluidic reservoirs may contain one a reagent carrier comprising one or more reagents configured to react with one or more components of the fluid. Two or more such fluidic reservoirs may comprise identical reagents, which may be helpful for performing reactions with the relevant component of the fluid to a relatively high yield. In some embodiments, two or more such fluidic reservoirs comprise different reagents and/or different combinations of reagents, which may be helpful for performing different, sequential reactions with the fluid.

In some fluidic systems comprising two or more reagent carriers comprising different reagents and/or different combinations of reagents from each other, each type of reagent carrier may have its own color. In other words, reagent carriers comprising an identical combination of reagents may have the same color as each other, and reagent carriers comprising different combinations of reagents may have different colors from each other. Color-coding reagent carriers in this manner may facilitate the accurate placement of reagent carriers in the desired locations in the fluidic device.

Figure 13A:
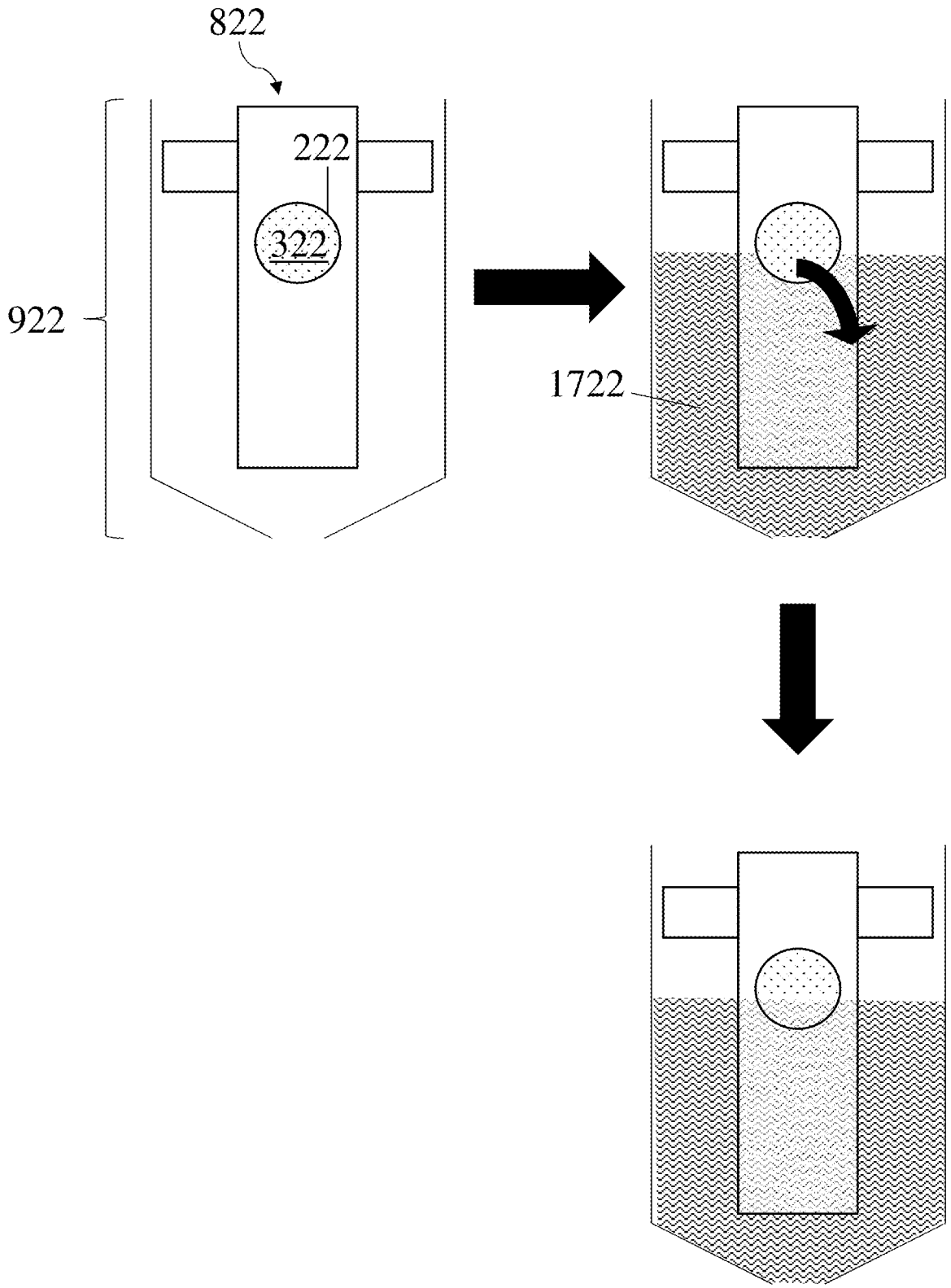
FIG. 13A shows a step of dissolving and/or suspending a portion of a reagent positioned in a reagent carrier into a liquid to which the reagent carrier is exposed, in accordance with some embodiments.

Some embodiments relate to methods, such as methods that relate to the reagent carriers, fluidic reservoirs, and/or fluidic systems described herein. In some embodiments, a method comprises releasing a reagent from a reagent carrier described herein into a liquid. For instance, in some embodiments, a method comprises dissolving and/or suspending a portion of a reagent positioned in a reagent carrier (e.g., positioned in a film disposed on at least a portion of its carrier body, positioned in a pellet contained in a well therein) into a liquid to which the reagent carrier is exposed. FIG. 13A shows a schematic depiction of one non-limiting embodiment of a method having such a step. In FIG. 13A, a reagent carrier 822 comprising a well 222 is positioned within a fluidic reservoir 922. A film 322 comprising one or more reagents is initially disposed within the well 222. In FIG. 13A, the reagent carrier 822, and the bottom portion of the well 222 therein, is subsequently exposed to a liquid 1722. Then, a portion of the film 322, and a portion of the reagent(s) therein, is suspended and/or dissolved in the liquid 1722.

Figure 13B:
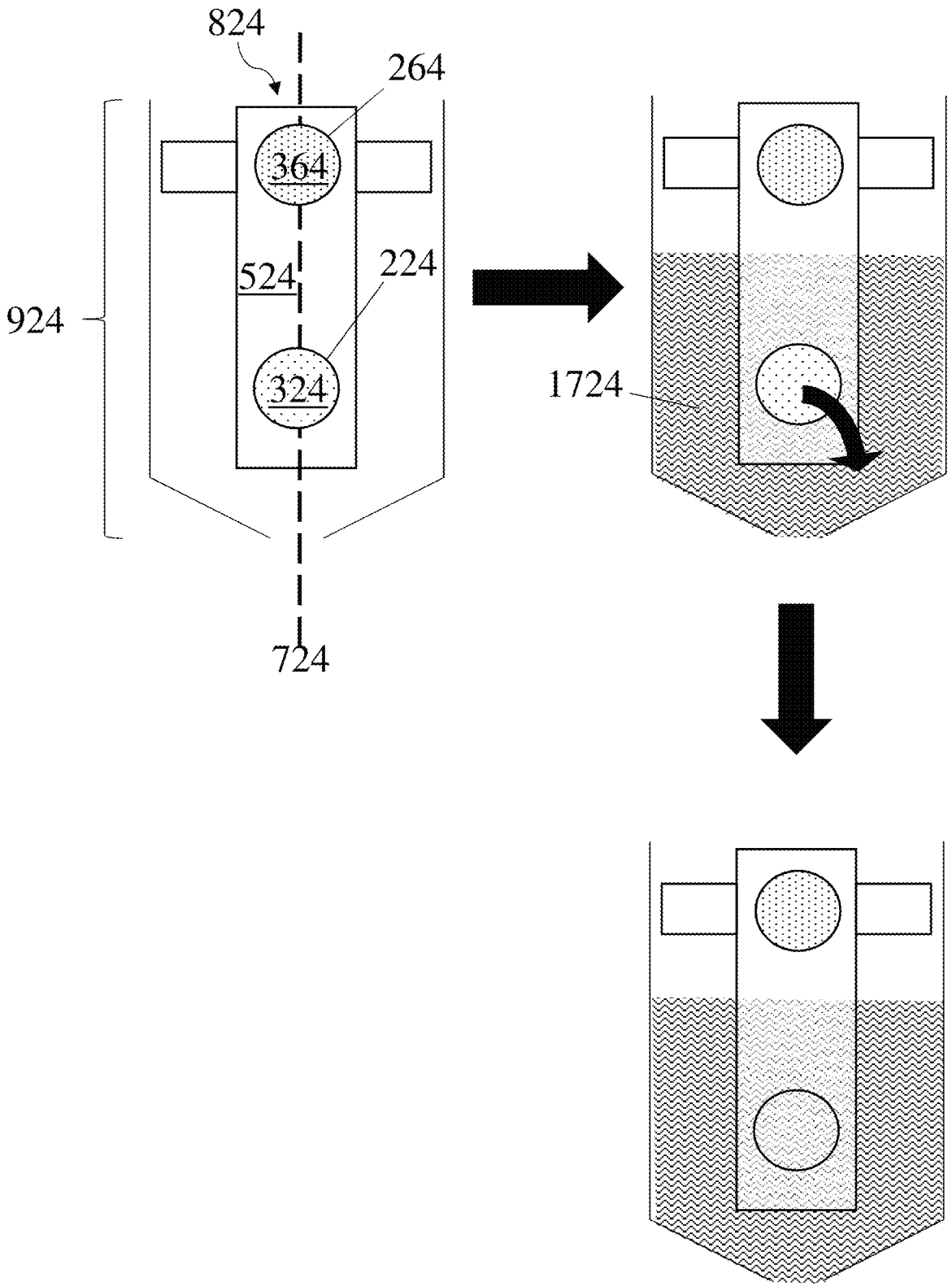
FIG. 13B shows a step of exposing a reagent carrier comprising two or more wells to a liquid in an amount such that some of the wells are exposed to the liquid and others are not, in accordance with some embodiments.

In some embodiments, like the embodiment shown in FIG. 13A, exposure of a reagent carrier to a liquid may cause a portion, but not all, of the reagents positioned on the reagent carrier to be released into the liquid. As another example, in some embodiments, a reagent carrier comprising two or more wells may be exposed to a liquid in an amount such that some of the wells are exposed to the liquid and others are not. Reagents disposed on and/or contained in the well(s) exposed to the liquid may be released into the liquid, and reagents disposed on and/or contained in the well(s) not exposed to the liquid may not be released into the liquid (e.g., they may be retained on and/or in the well(s), the liquid may not dissolve or suspend them). FIG. 13B shows a schematic depiction of one example of a method performed on a reagent carrier having this property. In FIG. 13B, the reagent carrier 824 comprises a first well 224 and a second well 264 positioned at different locations along the elongated axis 724 of the elongated portion 524. The first well 224 initially comprises a film 324 comprising a first reagent and the second well 264 initially comprises a film 364 comprising a second reagent. As also shown in FIG. 13B, the fluidic reservoir 924 constrains the reagent carrier 824 such that the first well 224 is positioned below the second well 264. In FIG. 13B, exposure of the reagent carrier 824 to the liquid 1724 in the amount shown causes a portion of the film 324, and a portion of the reagent(s) therein, to be suspended and/or dissolved in the liquid 1724 but does cause any portion of the film 364 (or any reagents therein) to be suspended or dissolved in the liquid 1724. Methods comprising a step like that shown in FIG. 13B may be advantageous when a reagent carrier comprises two or more distinct wells comprising reagents and it is desirable for the reagents in the distinct wells to be released therefrom at different points in time, as described elsewhere herein.

Figure 13C:
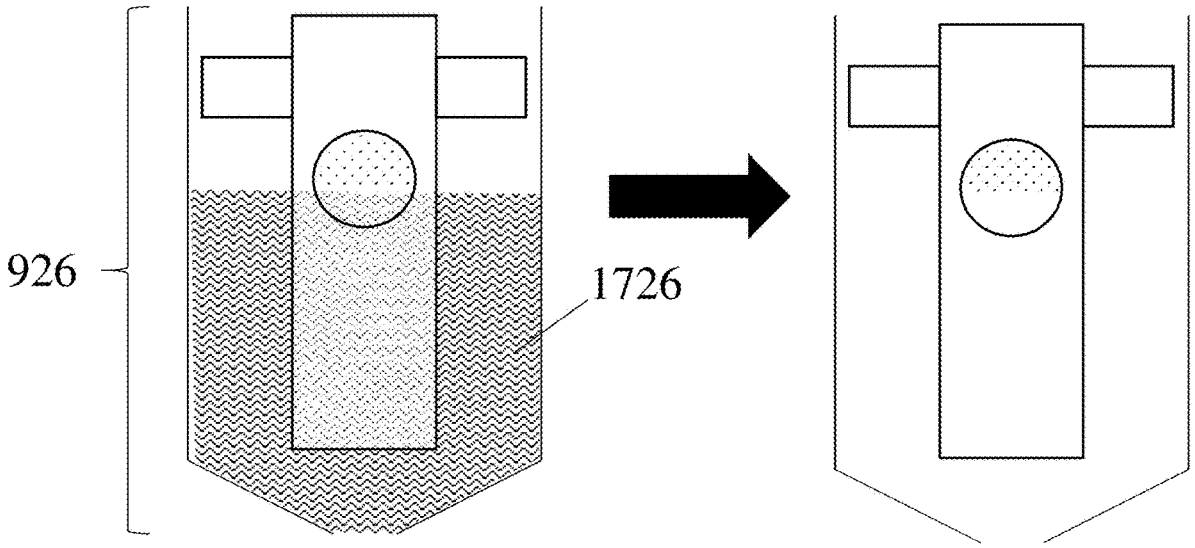
FIG. 13C shows a step of removing a liquid to which a reagent has been exposed from a fluidic reservoir, in accordance with some embodiments.

In some embodiments, method steps like those shown in FIGS. 13A and 13B may be combined with further steps. FIG. 13C shows a schematic depiction of one example of a further step. In FIG. 13C, a liquid to which a reagent had been exposed is removed from the fluidic reservoir. With reference to FIG. 13C, the liquid 1726 in the fluidic reservoir 926 may be removed therefrom. As shown in FIG. 13C, it is possible for removing the liquid from the fluidic reservoir to also comprise removing the reagent dissolved and/or suspended in the liquid from the fluidic reservoir. This may be desirable, for instance, if the liquid is employed to clean the reagent carrier prior to further analysis steps and/or if it is desirable for the reagent that is removed to then be transported to a different portion of the fluidic system by the liquid.

Figure 13D:
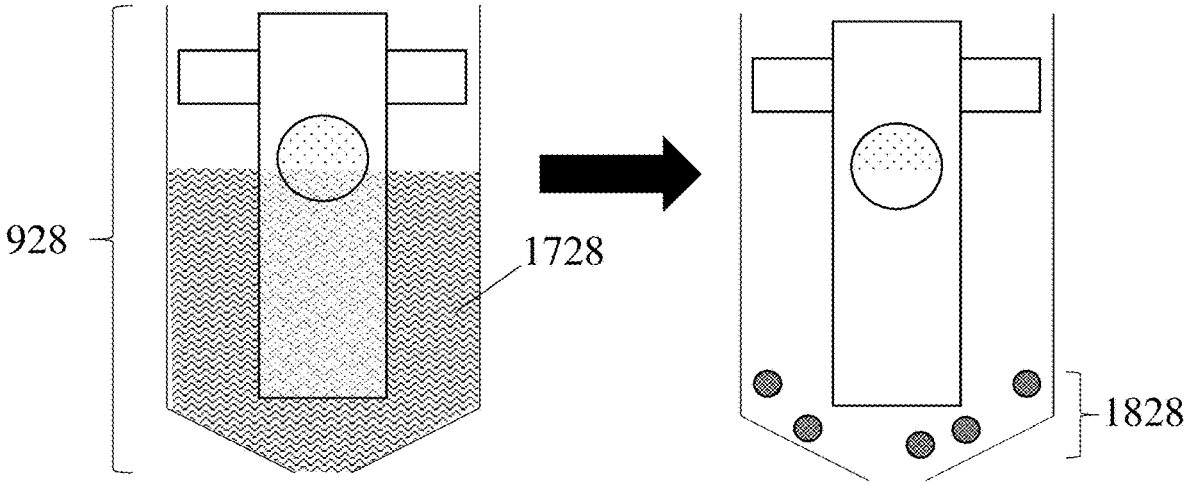
FIG. 13D shows a step of removing a liquid from a fluidic reservoir but retaining a reagent suspended therein in the fluidic reservoir, in accordance with some embodiments.

It is also possible for the liquid to be removed from the fluidic reservoir but for a reagent suspended and/or dissolved therein to be retained in the fluidic reservoir. This may be beneficial when it is desirable to perform one or more processes on the retained reagent when it is present in the fluidic reservoir, but for which it is also desirable to remove one or more components with which the retained reagent is initially intermixed (e.g., one or more components of a film in which the reagent is initially positioned) prior to performing subsequent steps in the fluidic reservoir (e.g., prior to the introduction of a sample to be analyzed by the fluidic device thereinto). As another example, it may be beneficial to retain a reagent suspended and/or dissolved in a liquid in a fluidic reservoir when the liquid in which it is suspended or dissolved is both configured to interact in a desirable manner with the reagent (e.g., by activating it) and has one or more properties that would make its presence undesirable during further processes performed with the reagent (e.g., when the liquid is undesirably reactive with further species to be exposed to the reagent). FIG. 13D shows one non-limiting embodiment of a step in which a liquid is removed from a fluidic reservoir but a reagent suspended therein is retained in the fluidic reservoir. In FIG. 13D, portions of the reagent initially present in the liquid 1728 are retained as particles 1828 in the fluidic reservoir 928 after the liquid 1728 is removed from the fluidic reservoir 928. Reagents may be retained in a fluidic reservoir a variety of suitable manners. In some embodiments, a field (e.g., a magnetic field) is employed for this purpose.

It should be noted that, although FIGS. 13C and 13D show the removal of a liquid from a fluidic reservoir after a portion of a reagent positioned in a single well of a reagent carrier is exposed thereto, it is also possible for liquid to be removed from a fluidic reservoir after exposure of the entirety of a reagent positioned in a well of a reagent carrier thereto, after exposure of at least portions of two or more reagents positioned in two or more different wells of a reagent carrier thereto, and/or after exposure of no reagents positioned on the reagent carriers thereto.

In some embodiments, a liquid may be applied to one or more of the above-referenced combinations of locations as part of an initial cleaning process. In some such embodiments, the liquid is one that is not configured to dissolve and/or suspend any reagents exposed to it and/or is configured to dissolve and/or suspend minimal amounts of any reagents exposed to it. Non-limiting examples of liquids suitable for this purpose include non-polar cleaning agents, such as acetone, hexane, carbon tetrachloride, and diethyl ether. As another example, in some embodiments, one or more reagents are removed from a reagent carrier but retained in the fluidic reservoir are exposed thereto.

Another example of a further method step that may be performed in combination with one or more of the other method steps described herein is a step of introducing a second liquid into the fluidic reservoir. This may be performed after the introduction of the first liquid and while the first liquid is still present in the fluidic reservoir. In such cases, the first and second liquids may mix together. This may be beneficial when, for instance, a first liquid is introduced into the fluidic reservoir and incubated therein for a period of time, and then a second liquid is introduced into the fluidic reservoir. The incubation period may allow for a reaction to take place (e.g., between a reagent dissolved and/or suspended in the first liquid and a component of the first liquid, between two or more reagents dissolved and/or suspended in the first liquid) that is desired to occur before introduction of the second liquid into the fluidic reservoir. For instance, in some embodiments, it may be desirable for a reaction to occur that transforms a first reagent dissolved and/or suspended in the first liquid into a second reagent suitable for reaction with a component of the second liquid. It may be desirable for this reaction to occur prior to the introduction of the second liquid for a variety of reasons. By way of example, the second liquid may comprise a species undesirably reactive with the first reagent prior to transformation into the second reagent, the incubation conditions (e.g., temperature, time) may promote undesirable reactions within the second liquid, etc.

In some embodiments, a second liquid is introduced into a fluidic reservoir already comprising a first liquid, and the second liquid is configured to interact with the first liquid in a desirable manner. By way of example, in some embodiments, the first liquid may be undesirably reactive with a third liquid to be introduced into the fluidic reservoir after the first and second liquids. The second liquid may be configured to neutralize the first liquid such that the third liquid may be introduced into the fluidic reservoir and/or exposed to the first liquid (e.g., to any portion of the first liquid left as a residue in the fluidic reservoir after most of the first liquid has been removed therefrom) without undergoing the undesirable reaction. As one specific example, in some embodiments, a first liquid has a pH that is undesirably acidic or basic and the second liquid comprises a buffering agent configured to reduce or raise the pH of the first liquid to a value acceptable for exposure to the third liquid.

It is also possible for a second liquid to be introduced into the fluidic reservoir after removal of the first liquid therefrom. One or more reagents positioned in the fluidic reservoir may be exposed thereto (and/or dissolved and/or suspended therein). For instance, at least a portion of a reagent suspended and/or dissolved in a first liquid, but retained in the fluidic reservoir after removal of the first liquid therefrom, may be exposed to the second liquid. As another example, at least a portion of a reagent not exposed to the first liquid may be exposed to the second liquid. This may occur when the reagent not exposed to the first liquid is disposed on and/or contained in a well-positioned at a location along an elongated axis of the reagent carrier such that, and when the reagent carrier is constrained by the fluidic reservoir such that, it is above the level that the first liquid reaches when introduced into the reagent carrier. In some embodiments, both types of reagents are exposed to the second liquid. In such cases, both types of reagents may be exposed to each other through the second liquid (e.g., when one or both reagents are dissolved and/or suspended in the second liquid). Advantageously, this may allow two reagents to be exposed to each other at a desired point in time (e.g., when a reaction resulting in a detectable product is desired to be performed) but not exposed to each other prior to that time. This process may also allow for a first reagent to be exposed to a first liquid that is incompatible with a second liquid (e.g., undesirably reactive with a second liquid) prior to exposure to the second liquid. The first liquid may perform a desired reaction with the first reagent, but be removed from the fluidic reservoir so that it does not undesirably react with the second liquid.

Figure 13E:
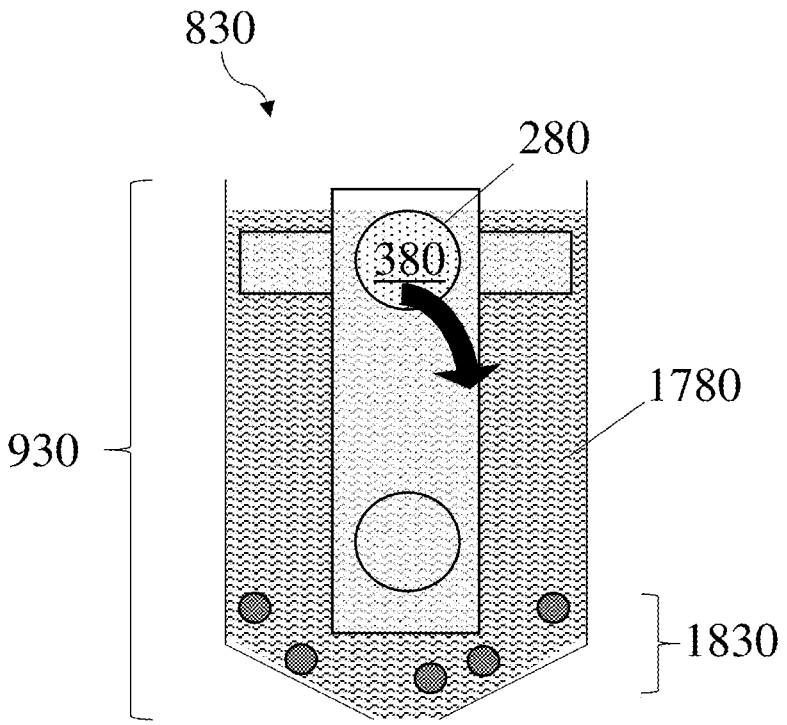
FIG. 13E shows a step of introducing a second liquid into a fluidic reservoir in which a reagent carrier is positioned, in accordance with some embodiments.

FIG. 13E shows a schematic depiction of one non-limiting example of a method step similar to that described in the preceding paragraph. In FIG. 13E, the second liquid 1780 is introduced into the fluidic reservoir 930 in which the reagent carrier 830 is positioned. Both the first reagent 1830 and the second reagent positioned in the film 380 disposed in the well 280 are exposed to the second liquid.

A third example of a further method step that may be performed in combination with one or more of the method steps described elsewhere herein is a step of performing one or more actions to promote mixing of a liquid positioned in a fluidic reservoir. This may be advantageous in circumstances in which it is beneficial to mix a component of the liquid (e.g., a first liquid introduced into the fluidic reservoir) with a reagent exposed thereto (e.g., a reagent positioned in a film disposed on at least a portion of a carrier body of a reagent carrier positioned therein, a reagent positioned in a pellet contained within a well in a reagent carrier positioned therein) and/or when it is beneficial to mix two reagents both exposed to the same liquid (e.g., first and second reagents, each of which are either positioned in a film disposed on a well in a reagent carrier or positioned in a pellet contained within a well in the reagent carrier; a first reagent that had been exposed to a first liquid and a second reagent that had not been exposed to the first liquid).

Mixing may be promoted in a variety of suitable manners, one example of which is the introduction of gas bubbles. For instance, gas bubbles having a lower density than the liquid may be introduced into the bottom of the fluidic reservoir and then transported upwards by gravity. In other words, a gas may bubbled (e.g., upwards) through a fluidic reservoir comprising a liquid (e.g., a first liquid, a second liquid).

Figure 13F:
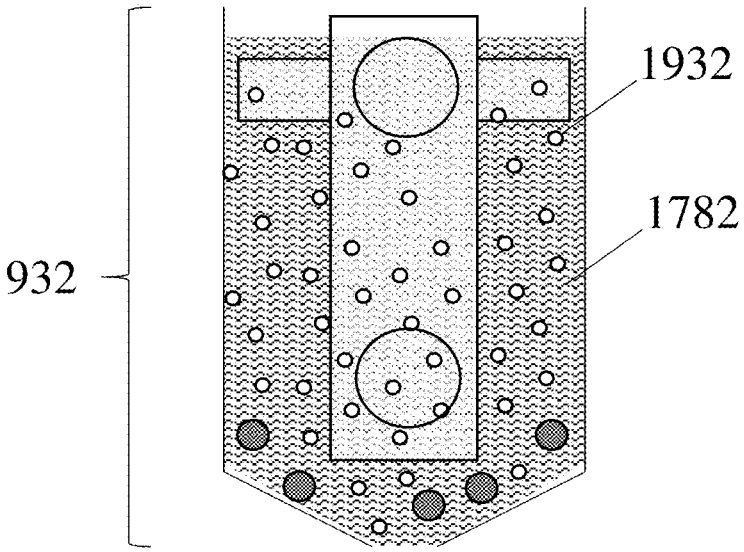
FIG. 13F shows a step of introducing a plurality of gas bubbles into a liquid from the bottom of the fluidic reservoir in which the liquid is positioned, in accordance with some embodiments.

FIG. 13F shows a schematic depiction of one non-limiting example of a method of promoting mixing in a fluidic reservoir comprising a liquid. In FIG. 13F, a plurality of gas bubbles (shown schematically with reference to the gas bubble 1932) is introduced into the liquid 1782 from the bottom of the fluidic reservoir 932 and are transported upwards under the influence of buoyancy forces.

It is also noted that, in some embodiments, the presence of gas bubbles in a fluidic reservoir comprising a liquid may increase the height of the liquid in the fluidic chamber. As the gas bubbles enter the fluidic reservoir, they may push some of the liquid already present therein upwards. This may, in some embodiments, result in the exposure of reagents positioned above the initial height of the liquid in the fluidic reservoir (i.e., the height of the liquid prior to the introduction of gas bubbles into the fluidic reservoir) to the liquid. By way of example, in some embodiments, a liquid may be present in a fluidic chamber that has a height that is lower than that of the bottom of a well in which a reagent is present (e.g., in a liquid film disposed thereon, in a pellet contained therein) and the introduction of gas bubbles into the liquid may cause the height of the liquid to rise such that it is above the bottom of the well. At least a portion (or all) of that reagent may then be exposed to the liquid (and, possibly, dissolved and/or suspended therein).

Figure 13G:
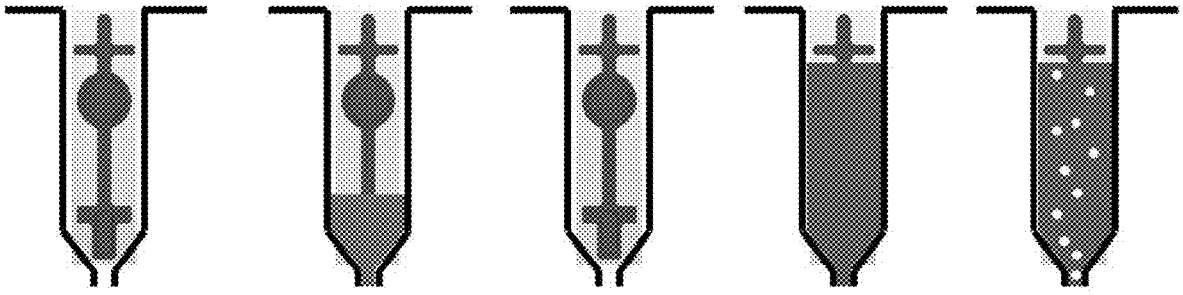
FIG. 13G shows a schematic depiction of a method comprising the steps of introducing a first liquid into a fluidic reservoir, removing the first liquid from the fluidic reservoir, introducing a second liquid into the fluidic reservoir, and introducing a plurality of gas bubbles into the second liquid from the bottom of the fluidic reservoir, in accordance with some embodiments.

FIG. 13G shows a schematic depiction of one non-limiting embodiment of a method comprising all of the steps described above. In FIG. 13G, a first liquid is introduced into a fluidic reservoir in an amount such that the bottom well, and any reagent positioned in a film disposed thereon and/or a pellet contained therein, is exposed thereto. Then, in FIG. 13G, the first liquid is fully removed from the fluidic reservoir. The next step shown in FIG. 13G is the introduction of a second liquid (that is different from the first liquid) into the fluidic reservoir in an amount such that both the bottom and top wells, and any reagent positioned in film(s) disposed thereon and/or pellet(s) contained therein), is exposed thereto. Finally, FIG. 13G shows the introduction of a plurality of gas bubbles into the fluidic reservoir to promote mixing between the second liquid and any reagents dissolved and/or suspended therein.

To supplement the overview of some possible designs for components of the fluidic systems described herein, the fluidic systems described herein, and methods that may be performed in the fluidic systems described herein provided above, further details related to such components, systems, and methods are provided below.

As described elsewhere herein, in some embodiments, a reagent carrier comprises a film comprising a reagent disposed on at least a portion of its carrier body. When present, this film may comprise a reagent and may further comprise other, additional components. In some embodiments, it may be advantageous for the film, as a whole, to have one or more physical properties consistent with the physical properties of a liquid (in other words, to be a "liquid film"). By way of example, in some embodiments, a liquid film exhibits a resistance to the application of force consistent with the manner in which a liquid would resist such force (i.e., that, under the application of a net force of that magnitude, it will flow). As another example, in some embodiments, a liquid film comprises one or more liquid components and one or more solid components, and the mechanical properties of the liquid film are dominated by those of the liquid components (e.g., the difference between the response of the liquid film to an applied mechanical force differs minimally from the response of an otherwise equivalent film lacking the solid components, or the character of the response of the liquid film to an applied mechanical force differs minimally from the response of an otherwise equivalent film lacking the solid components even if the magnitude of such response differs appreciably).

As described elsewhere herein, and without wishing to be bound by any particular theory, it is believed that the storage of reagents in liquid films may have one or more advantages in comparison to the storage of such reagents in solid films. For instance, a liquid film may be more readily released (e.g., dissolved and/or suspended) and/or released in a more uniform manner upon exposure to another liquid (e.g., a liquid introduced into a fluidic reservoir in which the reagent carrier is positioned). By way of example, a liquid film may be released in a manner such that the liquid to which it is exposed lacks clumps and/or aggregates of its components. Another example of an advantage associated with some liquid films is the ability to place the liquid film in a desired location on and/or in a reagent carrier (e.g., disposed on at least a portion of its carrier body, disposed on a well therein). A third example of an advantage associated with some liquid films is the ability to retain, in a defined location, a reagent that would otherwise be powdery and prone to being dispersed randomly over the interior of a fluidic reservoir in which it is positioned upon the application of forces typically experienced during transport and/or storage of the fluidic device.

In some embodiments, a liquid film that is disposed on at least a portion of a carrier body of a reagent carrier has a relatively high viscosity and/or relatively high surface tension. The relatively high viscosity and/or relatively high surface tension may assist with maintaining the liquid film in its initial morphology when the reagent carrier is positioned in a fluidic reservoir. For instance, the viscous force and surface tension may together apply a net force to the liquid film that balances the force applied by gravity to the liquid film, which may prevent the liquid film from flowing (and/or prevent the liquid film from flowing appreciably) under the influence of gravity. In some embodiments, a liquid film may have a combination of viscosity and surface tension that together prevent the liquid film from flowing (and/or prevent the liquid film from flowing appreciably) under the influence of gravity when positioned perpendicular to the direction of gravity (e.g., when its thinnest dimension is perpendicular to the direction of gravity) for an appreciable period of time. By way of example, this period of time may be at least one month, at least two months, at least three months, at least six months, at least nine months, at least one year, at least a year and a half, or at least two years.

It may be advantageous for liquid films to not flow under the influence of gravity (and/or to not flow appreciably under the influence of gravity) in embodiments in which the liquid film is initially disposed on at least a portion of a carrier body of a reagent carrier (e.g., on a well therein) in an orientation substantially parallel to an external surface of the carrier body. If the carrier body is subsequently placed in a fluidic reservoir in a manner in which that surface is relatively upright (e.g., if the fluidic reservoir constrains the reagent carrier such that that surface is relatively upright, such as if that surface comprises the elongated axis of an elongated portion of the reagent carrier and the elongated axis of an elongated portion of the reagent carrier forms a relatively small angle with the vertical axis of the fluidic reservoir), then the orientation of the liquid film may also be constrained to be relatively upright. For liquid films having relatively low viscosities and/or relatively low surface tensions, such a change in position may undesirably cause them to flow down the reagent carrier, out of the wells in which they were initially positioned, and/or off the reagent carrier. This flowing may disadvantageously cause reagents disposed on different portions of the reagent carrier to mix (e.g., reagents that are not configured to mix, reagents that are configured to mix at a defined point in time upon exposure to a common liquid) and/or to be released into a liquid introduced into the fluidic reservoir prematurely (e.g., a liquid introduced into the fluidic reservoir in a volume smaller than the volume that would cause the reagent to be exposed thereto if the liquid film had not flowed appreciably). By contrast, films with appreciable viscosities and/or surface tensions may be retained in their initial location, or close to it, when repositioned in this manner.

When present, a liquid film may comprise one or more liquids. The liquid(s) may be biocompatible, may be chemically compatible with the other components of the liquid film, and/or may have a relatively low volatility under the conditions to which the liquid film is exposed during fabrication and storage. In some embodiments, the liquid(s) share(s) one or more chemical properties with the liquid into which it or they are configured to release any reagents stored therein (e.g., aqueous liquids, organic liquids, samples to be analyzed by the fluidic device). For instance, the liquid(s) in the film and the liquid into which it or they are configured to release reagents may all be aqueous, polar, or non-polar. The liquid(s) may also be at least partially soluble and/or suspendable in the liquid into which it is configured to release any reagents stored therein (e.g., aqueous liquids, organic liquids, samples to be analyzed by the fluidic device). By way of example, some liquids present in the liquid films described herein are fully miscible in water and some liquids present in the liquid films described herein are not fully miscible in water. Non-limiting examples of suitable liquids include polyols (e.g., glycerol, trimethylolpropane, pentaerythritol, poly(vinyl alcohol)), sugar alcohols, dimethyl sulfoxide, poly(dimethyl siloxane), poly(propylene glycol), and poly(ethylene glycol). Non-limiting examples of suitable sugar alcohols include maltitol, sorbitol, xylitol, erythritol, inositol, and isomalt.

As described elsewhere herein, a liquid film may comprise one or more reagents. As used herein, the term "reagent" refers to a species that is configured to be dissolved and/or suspended in a liquid to which it is exposed. In some embodiments, the dissolution and/or suspension of a reagent in a liquid may change one or more physical or chemical properties of the liquid (e.g., its viscosity, density, pH, osmolarity, conductance, electrolyte strength, reactivity with a species to which it is exposed, tendency to foam, etc.).

In some embodiments, reagent(s) present in a liquid film is/are in solid form. In other words, the reagent(s) may be in the form of a material that itself behaves chemically like a bulk solid and not like a solute and/or particle suspended in a liquid. Without wishing to be bound by any particular theory, it is believed that it may be beneficial to store some reagents in solid form. For instance, reagents that are unstable at room temperature when dissolved and/or suspended in a bulk liquid (e.g., reagents that are unstable when dissolved and/or suspended in one or more liquids at room temperature, such as reagents that are unstable when dissolved and/or suspended in aqueous liquids at room temperature) may advantageously be stored in this form. It may also be beneficial to store a reagent in solid form when it is desirable for the reagent to be present in a liquid introduced into the fluidic reservoir at a concentration that is an appreciable fraction of its solubility limit in that liquid. In such cases, it would be necessary for the fluid introduced into the fluidic reservoir to not dilute the reagent concentration to a high degree, and so, undesirably, the reagent would need to be stored in an appreciable amount of liquid dissolving and/or suspending it. A third example of a situation in which it may be beneficial to store reagents in solid form is when the reagent (e.g., a particulate reagent, such as a bead) has a tendency to be suspended relatively unstably in the liquid in which it would be otherwise stored. Such reagents, if stored in liquids positioned in fluidic reservoirs, may be deposited in one or more undesirable locations in the fluidic reservoir if the liquid in which it stores sloshes around (e.g., during transport and/or storage of the fluidic system). Deposition of the reagent in unpredictable locations may make it challenging to reproducibly expose a defined amount of it to a defined volumes of liquid introduced into the fluidic reservoir in which it is stored.

Solid reagents present in a liquid film may be positioned with respect to the other components therein in a variety of suitable manners. In some embodiments, the solid reagents may be embedded (e.g., partially, fully) therein.

It should be noted that a liquid film may comprise a liquid reagent (e.g., in addition to a solid reagent, instead of a solid reagent) and/or for a reagent carrier to carry a reagent in a manner other than a liquid film (e.g., in the form a solid pellet, such as a solid lyophilized pellet). Like the liquids described above, the reagent(s) are also typically soluble and/or suspendable in the liquid into which it is configured to be released (e.g., aqueous liquids, organic liquids, samples to be analyzed by the fluidic device). Additionally, reagent(s) stored on and/or in a reagent carrier may have a variety of suitable morphologies and physical properties. For instance, the reagent(s) may comprise and/or be conjugated to particles and/or beads, such as microparticles, nanoparticles, microbeads, and/or nanobeads. Other examples of suitable morphologies that solid reagents may have include powders, flakes, aggregates, and pellets. Such solid reagents and/or solids to which reagents are conjugated may be inert (e.g., to conditions present during reagent storage, to conditions present during reagent dissolution and/or suspension) or may be configured to undergo one or more chemical reactions (e.g., during conditions present during reagent storage, during conditions present during reagent dissolution and/or suspension). Solid reagents and/or solids to which reagents are conjugated of either type may be insoluble in one or more (e.g., all) other components of a liquid film in which they are positioned and/or insoluble in one or more (e.g., all) liquid(s) to which they are exposed. In some embodiments, the solid reagents and/or solids to which reagents are conjugated may maintain substantially the same morphology over an appreciable period of time (e.g., when positioned in a liquid film, when released into a liquid, and/or when retained in a fluidic reservoir after removal of a liquid therefrom).

Solid reagents and solids to which reagents are conjugated may have a variety of suitable morphologies. Some solid reagents and/or solids to which reagents are conjugated (e.g., particles, beads, powders, flakes, aggregates, pellets) may be relatively spherical, relatively ovoid, and/or may have a structure comprising one or more edges and/or corners. Such solid reagents and/or solids to which reagents are conjugated may have an average diameter of greater than or equal to 0.1 micron, greater than or equal to 0.2 microns, greater than or equal to 0.5 microns, greater than or equal to 0.75 microns, greater than or equal to 1 micron, greater than or equal to 2 microns, greater than or equal to 5 microns, greater than or equal to 7.5 microns, greater than or equal to 10 microns, greater than or equal to 20 microns, greater than or equal to 50 microns, greater than or equal to 75 microns, greater than or equal to 100 microns, greater than or equal to 200 microns, greater than or equal to 500 microns, or greater than or equal to 750 microns. Such solid reagents and/or solids to which reagents are conjugated may have an average diameter of less than or equal to 1 mm, less than or equal to 750 microns, less than or equal to 500 microns, less than or equal to 200 microns, less than or equal to 100 microns, less than or equal to 75 microns, less than or equal to 50 microns, less than or equal to 20 microns, less than or equal to 10 microns, less than or equal to 7.5 microns, less than or equal to 5 microns, less than or equal to 2 microns, less than or equal to 1 micron, less than or equal to 0.75 microns, less than or equal to 0.5 microns, or less than or equal to 0.2 microns. Combinations of the above-referenced ranges are also possible (e.g., greater than or equal to 0.1 micron and less than or equal to 5 microns, greater than or equal to 0.5 microns and less than or equal to 10 microns, greater than or equal to 5 microns and less than or equal to 50 microns, greater than or equal to 10 microns and less than or equal to 100 microns, greater than or equal to 20 microns and less than or equal to 500 microns, or greater than or equal to 50 microns and less than or equal to 1 mm). Other ranges are also possible.

It is also possible for reagent(s) stored on and/or in a reagent carrier to be magnetic and/or to be conjugated to a magnetic object (e.g., the reagent(s) may comprise and/or be conjugated to magnetic particles and/or nanomagnetic particles). The use of magnetic reagents and/or reagents conjugated to magnetic objects may be particularly beneficial when such reagents are configured to be initially released into a first fluid and then retained in a fluidic chamber by a magnetic field concurrently with the removal of the first fluid therefrom.

Solid reagents and/or solids to which reagents are conjugated may have a variety of suitable compositions. For instance, solid reagents and/or solids to which reagents are conjugated may comprise glasses (e.g., silica), ceramics (e.g., zirconia, tungsten carbide), metals and/or metal alloys (e.g., zirconium, steel and/or stainless steel), and/or polymers (e.g., latex).

Reagents present in the reagent carriers described herein may be of a variety of suitable types. Non-limiting examples of such types include anion exchangers (e.g., strong or weak anion exchangers conjugated to particles, such as magnetic particles, non-limiting examples of which are described in WO 2016/044621 and WO 2017/160820). It is to be understood, that in some embodiments, anion exchangers may comprise at least a single tertiary and/or quaternary amine. Additional, non-limiting examples of reagents present in the reagent carriers include defoaming agents (e.g., Antifoam 204, Antifoam A, Antifoam B, Antifoam C, Antifoam Y-30, Antifoam SE-15, Antifoam BYK1723, Antifoam BYK607, Antifoam BYK2013, AntifoamBYK300, Antifoam-BYK081, Antifoam BYK1707, Antifoam BYK3750, Antifoam BYK3762, Antifoam BYK1630, Antifoam Fulcat-22F, Antifoam RHEBYK7405, Antifoam DISPERBYK2030, Antifoam RHEOBYK7610, Antifoam BYKETOL-WA), buffering agents (e.g., tris(hydroxypropyl) phosphine, 2-ethanesulfonic acid), salts (e.g., sodium fluoride, sodium chloride, magnesium chloride, potassium chloride), reducing agents (e.g., 1,4-dithiothreitol, 2-mercaptoethanol, tris(2-carboxyethyl)phosphine hydrochloride), surfactants (e.g., ionic surfactants, such as non-ionic surfactants, cationic surfactants and/or zwitterionic surfactants; ethylenediaminetetraacetic acid, cetrimonium bromide), metal chelating agents (e.g., ethylenediaminetetraacetic acid, ethylene glycol-bis(O-aminoethyl ether)-N,N,N',N'-tetraacetic acid), and enzymes (e.g., proteases, nucleases, lytic enzymes, polymerases, catabolic enzymes, anabolic enzymes). Without wishing to be bound by any particular theory, it is believed that defoaming agents may be particularly suitable for liquids that would otherwise foam to a relatively high degree. Such foaming may undesirably cause the liquid in a fluidic reservoir to extend to a height therein that is undesirably high and/or undesirably unpredictable (e.g., to a height that would expose reagents thereto that are not desired to be exposed thereto, to a height such that the liquid flows out the top of the fluidic reservoir), and it is believed that defoaming agents may mitigate and/or prevent such behavior.

In some embodiments, two or more reagents are stored together (e.g., in a common film, such as a common liquid film; in a common pellet). By way of example, in some embodiments, a defoaming agent and a buffering agent may be stored together (e.g., Tween and Antifoam 204 may be stored together), a surfactant and a buffering agent may be stored together (e.g., Tween and Tris-HCl may be stored together), and/or two different types of surfactants may be stored together (e.g., Tween and Triton may be stored together). The storage of an antifoaming agent and a detergent together may be particularly beneficial, as it is believed that the introduction of a detergent into a liquid may enhance the tendency of the liquid to foam. Two types of surfactants may be particularly useful when the reagent carrier is configured to introduce a combination of reagents into a fluidic reservoir to lyse cells present in a liquid therein. It is believed that different types of cells may be susceptible to lysis by different types of detergents (e.g., prokaryotic cells may be susceptible to lysis by a different set of detergents than eukaryotic cells), and so exposing such cells to combinations of various types of detergents may be particularly beneficial.

Some combinations of reagents may be particularly useful in combination, but particularly challenging to store together. One example of such a combination is cationic detergents and zwitterionic detergents. Without wishing to be bound by any particular theory, it is believed that cationic detergents and zwitterionic detergents may coprecipitate out of solution together if dissolved in a common solution. This may make it challenging to form a liquid film comprising both a cationic detergent and a zwitterionic detergent and/or may result in undesirable coprecipitation of these detergents if released into a common liquid. Accordingly, in embodiments in which it is desirable for both cationic and zwitterionic detergents to be released into a liquid present in a single fluidic reservoir (e.g., into different liquids positioned therein at different points in time), it may be desirable to store the cationic and zwitterionic detergents separately.

In some embodiments, a reagent carrier comprises a species that is not a reagent (e.g., that is also not a liquid). Such species may be disposed on at least a portion of the carrier body of the reagent carrier (e.g., on a well therein) and/or may be positioned in a film further comprising a liquid and/or one or more reagents. Such species may assist with the dissolution and/or suspension of reagents also disposed on the reagent carrier in a liquid to which the species and such reagents are exposed. In some embodiments, a species other than a reagent that is disposed on at least a portion of a carrier body of a reagent carrier enhances the short- and/or long-term storage stability of reagents also disposed on that reagent carrier's carrier body. A third example of a benefit that a species other than a reagent disposed on at least a portion of a carrier body may provide is assistance with reagent carrier manufacturing and/or the deposition of further species on the reagent carrier (e.g., one or more liquids, one or more reagents). Species falling into this latter category may be particularly beneficial when simplified manufacturing processes are employed, such as processes characterized by and/or requiring reduced deposition tolerances, reduced deposition times, high uniformity, high reliability, improved upstream manufacturability, and/or high long-term stability.

In some embodiments, a material in which a reagent is positioned, such as a film (e.g., a liquid film) and/or a pellet is substantially free of a substance. By way of example, in some embodiments, the material is substantially free of water.

When a film, such as a liquid film, comprises both a solid reagent and a liquid, the relative amounts of the solid reagent and the liquid may generally be selected as desired. In some embodiments, a ratio of the weight of solid reagent in the film to the weight of liquid in the film is greater than or equal to 0.001, greater than or equal to 0.002, greater than or equal to 0.005, greater than or equal to 0.0075, greater than or equal to 0.01, greater than or equal to 0.02, greater than or equal to 0.05, greater than or equal to 0.075, greater than or equal to 0.1, greater than or equal to 0.2, greater than or equal to 0.5, greater than or equal to 0.75, greater than or equal to 1, greater than or equal to 2, greater than or equal to 5, greater than or equal to 7.5, greater than or equal to 10, greater than or equal to 20, greater than or equal to 50, or greater than or equal to 75. In some embodiments, a ratio of the weight of solid reagent in the film to the weight of liquid in the film is less than or equal to 100, less than or equal to 75, less than or equal to 50, less than or equal to 20, less than or equal to 10, less than or equal to 7.5, less than or equal to 5, less than or equal to 2, less than or equal to 1, less than or equal to 0.75, less than or equal to 0.5, less than or equal to 0.25, less than or equal to 0.1, less than or equal to 0.075, less than or equal to 0.05, less than or equal to 0.025, less than or equal to 0.01, less than or equal to 0.0075, less than or equal to 0.005, or less than or equal to 0.002. Combinations of the above-referenced ranges are also possible (e.g., greater than or equal to 0.001 and less than or equal to 100). Other ranges are also possible. When a fluidic system comprises two or more films (e.g., two or more films positioned on a common reagent carrier, two or more films positioned on different reagent carriers), each film may independently comprise a solid reagent and a liquid in a weight ratio in one or more of the ranges described above.

As described elsewhere herein, some embodiments relate to reagent carriers having a design that is beneficial for containing reagents and/or that interacts with a fluidic reservoir in which it is positioned in a beneficial manner. Further details regarding structural features that the reagent carriers described herein may have are provided below.

In some embodiments, the use of a reagent carrier to support and/or contain one or more reagents may be particularly advantageous. Two examples of such advantages relate to the ability to remove undesired and volatile components (e.g., liquids) from the reagents prior to assembly of the fluidic device. For instance, the use of a reagent carrier may allow for the removal of such components from the reagents prior to assembly of the fluidic device by allowing the reagent carrier to be dried separately from the fluidic device and/or may allow for such components to be removed from different reagents separately by positioning them on different reagent carriers that are dried separately. Some advantages associated with reagent carriers relate to reproducibility. For instance, because reagent carriers are small, they may be dried in large batches (which may enhance uniformity and/or facilitate rapid fabrication of reagent carriers comprising reagents) and/or may be easily stored. A third type of advantage may flow from the constraint of the reagent carriers by fluidic reservoirs as described elsewhere herein. Such constraint may cause the reagent carriers to remain in relatively constant locations within the fluidic reservoirs during storage and/or handling, which may protect the reagents and/or promote assay reproducibility and/or reliability.

As also described above, in some embodiments, a reagent comprises a carrier body. The carrier body may comprise an elongated portion and one or more protrusions protruding therefrom. For instance, a reagent carrier may comprise two or more protrusions, three or more protrusions, four or more protrusions, and/or an even larger number of protrusions. Such protrusion(s) may have a variety of shapes and sizes. For instance, in some embodiments, such protrusion(s) may be straight (e.g., they may lack curves, bends, and/or kinks). As another example, in some embodiments, a carrier body comprises one or more protrusions (e.g., straight protrusions) that form a 90° angle with the elongated portion (e.g., the protrusion(s) may intersect the elongated portion such that the intersecting surfaces form a 90° angle, the longest principal axis of the protrusion(s) may form a 90° angle with the elongated axis of the elongated portion). As a further example, in some embodiments, a carrier body comprises two protrusions that form a 180° angle with each other, three protrusions that form 120° angles with each other, and/or four protrusions that form 90° angles with their nearest neighbors (e.g., in addition to forming a 90° angle with the elongated axis of the elongated portion and/or being straight). In general, it should be understood that, when a reagent carrier comprises two or more protrusions, each protrusion may independently have some or all of the properties described herein (e.g., some or all of the properties in this paragraph).

Figure 14:
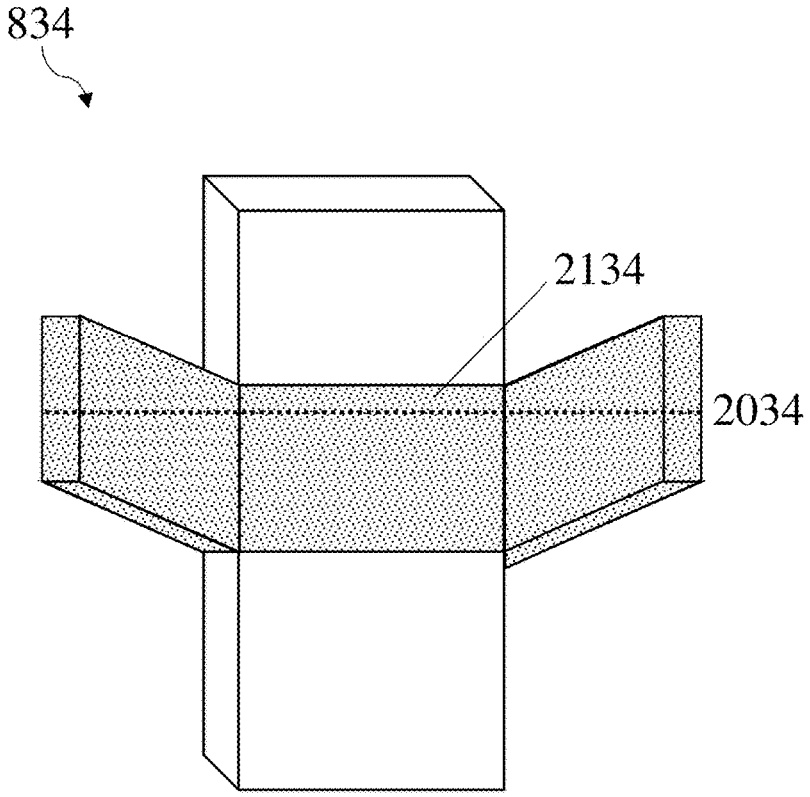
FIG. 14 shows a reagent carrier having a maximum width, in accordance with some embodiments.

Protrusion(s) protruding from an elongated portion of a carrier body may cause the carrier body to have a width (i.e., an extent in a direction perpendicular to the direction along which its length is assessed as described below) that varies along its length. Accordingly, in some embodiments, it may be beneficial to characterize the width of the carrier body by a maximum width. As used herein, the "maximum width" of a carrier body is the length of the longest line segment that may be drawn that has both endpoints on the carrier body and is either perpendicular to the elongated axis of the elongated portion or is skew thereto but would be perpendicular thereto if both the line segment and the elongated axis of the elongated portion were projected onto the plane perpendicular to the shortest line segment connecting them. As used herein, the "portion of the carrier body having the maximum width" is the cross-section of the carrier body perpendicular to the elongated axis of the elongated portion that comprises the endpoints of the line segment described in the preceding sentence. With reference to FIG. 14, a reagent carrier 834 has a maximum width of 2034 and a portion 2134 having the maximum width.

In some embodiments, the portion of the carrier body having the maximum width is positioned proximate to an upper portion of the carrier body. Without wishing to be bound by any particular theory, it is believed that this feature may be desirable when the reagent carrier is configured to be constrained by a reagent carrier in which it is positioned. It is believed that, when the reagent carrier is disposed in a fluidic reservoir such that it is tilted, the deviation in the position of a portion of the reagent carrier from the position it would occupy if untilted increases from the bottom of the reagent carrier to its top. Accordingly, it is believed that, at a given angle of tilt, the position of the upper portion of the reagent carrier will differ more from the position it would take if the reagent carrier were untilted than the lower portion of the reagent carrier. For this reason, it is believed that a constraint placed on the positions that the upper portion of the reagent carrier can take may have a larger effect on the angles that the reagent carrier can tilt over than a similar constraint placed on the positions that the lower portion of the reagent carrier can take. Therefore, it is believed that reagent carriers for which the portion of the reagent carrier having the maximum width is proximate the upper portion of the carrier body are relatively more constrained, and/or are more readily constrained, by fluidic reservoirs in which they are positioned than reagent carriers for which the portion having the maximum width is proximate the lower portion of the carrier body. It is also believed that such reagent carriers may thus desirably be more facile to constrain and/or constrained to a higher degree by the fluidic reservoirs described herein.

When the elongated portion is present, it may have a variety of suitable lengths. As used herein, the "length" of an elongated portion is the length of the line segment formed by perpendicularly projecting the elongated portion onto its elongated axis. In some embodiments, an elongated portion has a length of greater than or equal to 1 cm, greater than or equal to 1.5 cm, greater than or equal to 2 cm, greater than or equal to 2.5 cm, greater than or equal to 3 cm, greater than or equal to 4 cm, greater than or equal to 5 cm, greater than or equal to 6 cm, greater than or equal to 8 cm, greater than or equal to 10 cm, greater than or equal to 12.5 cm, greater than or equal to 15 cm, or greater than or equal to 17.5 cm. In some embodiments, an elongated portion has a length of less than or equal to 20 cm, less than or equal to 17.5 cm, less than or equal to 15 cm, less than or equal to 12.5 cm, less than or equal to 10 cm, less than or equal to 8 cm, less than or equal to 6 cm, less than or equal to 5 cm, less than or equal to 4 cm, less than or equal to 3 cm, less than or equal to 2.5 cm, less than or equal to 2 cm, or less than or equal to 1.5 cm. Combinations of the above-referenced ranges are also possible (e.g., greater than or equal to 1 cm and less than or equal to 20 cm). Other ranges are also possible. When a fluidic system comprises two or more reagent carriers, each reagent carrier may independently comprise an elongated portion having a length in one or more of the ranges described above.

The carrier bodies of the reagent carriers described herein may have a variety of suitable maximum widths. In some embodiments, the maximum width of the carrier body is greater than or equal to 0.5 cm, greater than or equal to 0.6 cm, greater than or equal to 0.8 cm, greater than or equal to 1 cm, greater than or equal to 2 cm, greater than or equal to 3 cm, greater than or equal to 4 cm, greater than or equal to 5 cm, greater than or equal to 6 cm, or greater than or equal to 8 cm. In some embodiments, the maximum width of the carrier body is less than or equal to 10 cm, less than or equal to 8 cm, less than or equal to 6 cm, less than or equal to 5 cm, less than or equal to 4 cm, less than or equal to 3 cm, less than or equal to 2 cm, less than or equal to 1 cm, less than or equal to 0.8 cm, or less than or equal to 0.6 cm. Combinations of the above-referenced ranges are also possible (e.g., greater than or equal to 0.5 cm and less than or equal to 10 cm). Other ranges are also possible. When a fluidic system comprises two or more reagent carriers, each reagent carrier may independently have a maximum width in one or more of the ranges described above.

The carrier bodies of the reagent carriers described herein may have a variety of suitable aspect ratios. As used herein, the "aspect ratio" of a reagent carrier is the ratio of the length of the reagent carrier to its maximum width. As also used herein, the "length" of a reagent carrier is the length of the longest line segment formed by perpendicularly projecting the reagent carrier onto one of its principal axes. The carrier body may have an aspect ratio of greater than or equal to 2, greater than or equal to 2.5, greater than or equal to 3, greater than or equal to 3.5, greater than or equal to 4, greater than or equal to 5, greater than or equal to 6, greater than or equal to 8, greater than or equal to 10, greater than or equal to 12.5, greater than or equal to 15, or greater than or equal to 17.5. The carrier body may have an aspect ratio of less than or equal to 20, less than or equal to 17.5, less than or equal to 15, less than or equal to 12.5, less than or equal to 10, less than or equal to 8, less than or equal to 6, less than or equal to 5, less than or equal to 4, less than or equal to 3.5, less than or equal to 3, or less than or equal to 2.5. Combinations of the above-referenced ranges are also possible (e.g., greater than or equal to 2 and less than or equal to 20). Other ranges are also possible. When a fluidic system comprises two or more reagent carriers, each reagent carrier may independently have an aspect ratio in one or more of the ranges described above.

In some embodiments, it may be informative to characterize one or more dimensions of a reagent carrier with respect to a fluidic reservoir in which it is positioned and/or in which it is configured to be positioned. By way of example, in some embodiments, it may be informative to characterize the length of the elongated portion with respect to the height of a fluidic reservoir in which it is positioned and/or in which it is configured to be positioned. As used herein, the "height" of a fluidic reservoir is the length of the line segment formed by projecting the fluidic reservoir onto its vertical axis. In some embodiments, the length of the elongated portion is greater than or equal to 50%, greater than or equal to 55%, greater than or equal to 60%, greater than or equal to 65%, greater than or equal to 70%, greater than or equal to 75%, greater than or equal to 80%, greater than or equal to 85%, greater than or equal to 90%, or greater than or equal to 95% of the height of the fluidic reservoir in which it is positioned and/or configured to be positioned. In some embodiments, the length of the elongated portion is less than or equal to 100%, less than or equal to 95%, less than or equal to 90%, less than or equal to 85%, less than or equal to 80%, less than or equal to 75%, less than or equal to 70%, less than or equal to 65%, less than or equal to 60%, or less than or equal to 55% of the height of the fluidic reservoir in which it is positioned and/or configured to be positioned. Combinations of the above-referenced ranges are also possible (e.g., greater than or equal to 50% and less than or equal to 100%). Other ranges are also possible. When a fluidic system comprises two or more reagent carriers, each reagent carrier may independently comprise an elongated portion having a length in one or more of the ranges described above.

As another example of a feature of a reagent carrier that it may be desirable to characterize in relation to a feature of a fluidic reservoir in which it is positioned, in some embodiments, a reagent carrier has a volume that is relatively small in comparison to the volume of the reagent carrier. Advantageously, in such embodiments, a large percentage of the volume of the fluidic reservoir may be unoccupied by the reagent carrier and suitable for performing reactions therein. By way of example, in some embodiments, the volume of reagent carrier is less than or equal to 60%, less than or equal to 55%, less than or equal to 50%, less than or equal to 45%, less than or equal to 40%, less than or equal to 35%, less than or equal to 30%, less than or equal to 25%, less than or equal to 20%, less than or equal to 15%, less than or equal to 10%, less than or equal to 5%, less than or equal to 2.5%, or less than or equal to 1%, of the volume of the fluidic reservoir in which it is positioned. In some embodiments, the volume of the reagent carrier is greater than 0%, greater than or equal to 1%, greater than or equal to 2.5%, greater than or equal to 5%, greater than or equal to 10%, greater than or equal to 15%, greater than or equal to 20%, greater than or equal to 25%, greater than or equal to 30%, greater than or equal to 35%, greater than or equal to 40%, greater than or equal to 45%, greater than or equal to 50%, or greater than or equal to 55% of the volume of the fluidic reservoir in which it is positioned. Combinations of the above-referenced ranges are also possible (e.g., less than or equal to 60% and greater than 0%). Other ranges are also possible. When a fluidic system comprises two or more reagent carriers, each reagent carrier may independently have a volume in one or more of the ranges described above.

As described elsewhere herein, some embodiments relate to reagent carriers comprising one or more wells. Further details regarding such wells are provided below.

In some embodiments, it may be advantageous to position one or more reagents in a wells (e.g., in a liquid film disposed and/or deposited in a well). For instance, it may be relatively facile to spot a reagent into a well in a manner such that the reagent is positioned exclusively in the well. In reagent carriers comprising multiple wells, different reagents may be positioned in close proximity to each other but not be exposed to each other if they are spotted into separate wells. This may be desirable when the different reagents are incompatible with each other, are reagents that are configured to react with each other in the presence of a liquid introduced into a fluidic reservoir in which the reagent carrier is positioned (but not before the introduction of such liquid), and/or are configured to be exposed to each other only after the activation of one of them (e.g., by a liquid introduced into a fluidic reservoir in which the reagent carrier is positioned and that is exposed to the reagent to be activated but not the other reagent). It may also be desirable to store different reagents separately that dissolve and/or suspend at different rates in a liquid to which they are both configured to be dissolved and/or suspended in the fluidic reservoir. In such embodiments, for example, the reagent that dissolves and/or suspends more slowly may be positioned in a well that is exposed to the liquid first, and then, after at least partial suspension of that reagent, further liquid may be introduced into the fluidic reservoir to dissolve and/or suspend the other reagent. Another example of an advantage associated with the use of wells to support and/or contain reagents is the ability to control the order that reagents positioned on and/or contained by the reagent carrier are exposed to liquids by selecting the positions of the wells and their contents.

Wells present in the reagent carriers described herein may have a variety of suitable shapes. In some embodiments, a well may comprise straight walls that are positioned perpendicular to a base. The shape enclosed by the walls may be, for instance, circular, oval, rectangular, polygonal, and/or may comprise portions that are curved and portions that are straight. When a reagent carrier comprises two or more wells, each well may independently have one or more of the shapes described above. A reagent carrier comprising two or more wells may comprise wells that each have a different shape, may comprise at least one well having the same shape as at least one other well and a different shape from at least one other well, and/or may comprise wells that all have the same shape.

As described elsewhere herein, two or more wells present in a reagent carrier may comprise two wells positioned at different locations along the elongated axis of the elongated portion (i.e., such that, when projected perpendicularly onto the elongated axis, the wells do not overlap; the lower of such wells may be referred to as being positioned "below" or "beneath" the upper such well when the reagent carrier is oriented such that the lower well is closer to the ground than the upper well) and/or two wells positioned at the same location along the elongated axis of the elongated portion (i.e., such that, when projected perpendicularly onto the elongated axis, at least a portion of the wells overlap; such wells may also be referred to as being positioned "beside each other"). The former arrangement may be desirable for wells in which reagents are positioned that it would be beneficial to introduce into a fluid positioned in the fluidic system at different points in time (e.g., sequentially). The latter arrangement may be desirable for wells in which reagents are positioned that it would be beneficial to introduce into a fluid positioned in the fluidic system at similar points in time (or the same point in time). In some embodiments, a reagent carrier comprises a well that is positioned beside two wells that are positioned at different locations along the elongated axis from each other.

FIGS. 8D-8H depict reagent carriers comprising the above-described types of combinations of wells. With reference to FIG. 8D specifically, the wells 1, 2, 3, and 4 are all positioned at different locations along the elongated axis. Similarly, also with reference to FIG. 8D, the wells 1, 2, and 5 are positioned at different locations along the elongated axis. In FIG. 8D, the wells 3 and 4 are positioned beside the well 5.

Wells present in the reagent carriers described herein may have a variety of suitable volumes. In some embodiments, a reagent carrier comprises a well having a volume of greater than or equal to 1 microliter, greater than or equal to 2 microliters, greater than or equal to 5 microliters, greater than or equal to 7.5 microliters, greater than or equal to 10 microliters, greater than or equal to 20 microliters, greater than or equal to 50 microliters, greater than or equal to 75 microliters, greater than or equal to 100 microliters, greater than or equal to 200 microliters, greater than or equal to 500 microliters, greater than or equal to 750 microliters, greater than or equal to 1000 microliters, or greater than or equal to 1250 microliters. In some embodiments, a reagent carrier comprises a well having a volume of less than or equal to 1500 microliters, less than or equal to 1250 microliters, less than or equal to 1000 microliters, less than or equal to 750 microliters, less than or equal to 500 microliters, less than or equal to 200 microliters, less than or equal to 100 microliters, less than or equal to 75 microliters, less than or equal to 50 microliters, less than or equal to 20 microliters, less than or equal to 10 microliters, less than or equal to 7.5 microliters, less than or equal to 5 microliters, or less than or equal to 2 microliters. Combinations of the above-referenced ranges are also possible (e.g., greater than or equal to 1 microliter and less than or equal to 1500 microliters). Other ranges are also possible. When a reagent carrier comprises two or more wells, each well may independently have a volume in one or more of the ranges described above.

A reagent carrier comprising two or more wells may comprise wells that each have a different volume, may comprise at least one well having the same volume as at least one other well and a different volume from at least one other well, and/or may comprise wells that all have the same volume.

When a reagent carrier comprises two or more wells, the wells may be spaced from each other at a variety of suitable distances. In some embodiments, a reagent carrier comprises two wells that are spaced from each other at a distance of greater than or equal to 0.1 cm, greater than or equal to 0.15 cm, greater than or equal to 0.2 cm, greater than or equal to 0.25 cm, greater than or equal to 0.3 cm, greater than or equal to 0.4 cm, greater than or equal to 0.5 cm, greater than or equal to 0.6 cm, greater than or equal to 0.8 cm, greater than or equal to 1 cm, greater than or equal to 1.25 cm, greater than or equal to 1.5 cm, greater than or equal to 1.75 cm, greater than or equal to 2 cm, greater than or equal to 2.5 cm, greater than or equal to 3 cm, greater than or equal to 3.5 cm, greater than or equal to 4 cm, greater than or equal to 4.5 cm, or greater than or equal to 5 cm. In some embodiments, a reagent carrier comprises two wells that are spaced from each other at a distance of less than or equal to 5 cm, less than or equal to 4.5 cm, less than or equal to 4 cm, less than or equal to 3.5 cm, less than or equal to 3 cm, less than or equal to 2.5 cm, less than or equal to 2 cm, less than or equal to 1.75 cm, less than or equal to 1.5 cm, less than or equal to 1.25 cm, less than or equal to 1 cm, less than or equal to 0.8 cm, less than or equal to 0.6 cm, less than or equal to 0.5 cm, less than or equal to 0.4 cm, less than or equal to 0.3 cm, less than or equal to 0.25 cm, less than or equal to 0.2 cm, or less than or equal to 0.15 cm. Combinations of the above-referenced ranges are also possible (e.g., greater than or equal to 0.1 cm and less than or equal to 5 cm). Other ranges are also possible.

The ranges in the preceding paragraph may characterize several different possible distances between wells. For instance, in some embodiments, the centroids of two wells may be separated by a distance in one or more of the ranges in the preceding paragraph. As another example, in some embodiments, the portions of two wells that are closest together (i.e., that can be connected by a line segment having the shortest length) may be in one or more of the ranges described above. As a third example, in some embodiments, the ranges describe above characterize the separation between two wells in a particular direction. For instance, a reagent carrier may comprise two wells for which the centroids are separated in the vertical direction, horizontal direction, and/or along the direction of the elongated axis of the reagent carrier by a distance in one or more of the ranges described above. As yet another example, a reagent carrier may comprise two wells for which the portions of the two wells closest together along the vertical direction, horizontal direction, and/or the elongated axis is in one or more of the ranges described above. It should also be understood that if a reagent carrier comprises three or more wells, for any pair of wells, each of the types of distances described above may independently be in one or more of the ranges in the preceding paragraph.

For liquids expected to foam and/or for which foaming is a possibility, in some embodiments, it may be desirable for a well desired not to be exposed to such a liquid to be separated vertically by a relatively large distance (e.g., in one or more of the larger ranges described above). In such cases, the liquid expected to possibly foam may be introduced into a fluidic reservoir comprising a reagent carrier comprising such wells in an amount sufficient to expose the reagents in the lower well thereto but insufficient to expose the reagents in the upper well thereto (e.g., even when the liquid undergoes appreciable foaming).

As described elsewhere herein, some embodiments relate to systems comprising fluidic reservoirs, reagent carriers positioned in and/or configured to be positioned in fluidic reservoirs, and/or methods performed (at least partially) in fluidic reservoirs. More detail regarding some features of suitable fluidic reservoirs is provided below.

In some embodiments, a fluidic reservoir is configured such that one or more fluids may be introduced thereinto and/or removed therefrom. For instance, as described elsewhere herein, in some embodiments, a fluid (e.g., a liquid, a gas bubbled through a liquid present in the fluidic channel)

may be introduced into a fluidic reservoir from the bottom of the fluidic reservoir. In such embodiments, the fluidic reservoir may comprise an inlet positioned at its lowermost portion (or close thereto). The fluid may flow into the fluidic reservoir from this inlet. It is also possible that a fluid may flow out of the fluidic reservoir from this inlet (e.g., that the inlet may act as both an inlet and an outlet) and/or that a fluidic reservoir may comprise an outlet positioned at its lowermost portion (e.g., in addition to or instead of an inlet). In some embodiments, a fluidic reservoir comprises an inlet and/or an outlet positioned at its top. This may be beneficial for introducing fluid into the fluidic reservoir and/or removing fluid from a fluidic reservoir from its top. For instance, a fluid (e.g., a gas) may be introduced into a fluidic reservoir from its top in order to apply pressure to expel a fluid (e.g., a liquid) positioned in the fluidic reservoir from an outlet positioned at its bottom. This fluid may, in some embodiments, be pumped in to the fluidic reservoir from the top under pressure (e.g., a pressure in excess of atmospheric pressure, a pressure less than atmospheric pressure). An inlet and/or an outlet positioned at the top of a fluidic reservoir also may be beneficial for removing a fluid already present in a fluidic reservoir upon the introduction of a fluid thereinto from an inlet positioned at its bottom. By way of example, a gas initially present in a fluidic reservoir may be removed from an outlet positioned at the top of a fluidic reservoir upon introduction of a liquid into the fluidic reservoir from an inlet positioned at the bottom of the fluidic reservoir. It is also possible for a fluidic reservoir to have an open top.

As described elsewhere herein, in some embodiments, a fluidic reservoir is configured to interact with a reagent carrier such that the fluidic reservoir constrains the reagent carrier. In some embodiments, like the embodiments shown in FIGS. 8A-8H, the reagent carrier comprises one or more features, such as one or more protrusions, configured to interact with the fluidic reservoir such that its position is constrained. It is also possible for the fluidic reservoir to comprise one or more features configured to constrain the reagent carrier. For instance, in some embodiments, a fluidic reservoir has a cross-sectional diameter that varies across its vertical axis. As an example, the fluidic reservoir may comprise a lower portion and an upper portion, and the lower portion may have a cross-sectional diameter that is smaller than the cross-sectional diameter of the upper portion. In some such embodiments, the fluidic reservoir comprises a lower portion that has a cross-sectional diameter that tapers from an upper, maximum value to a lower, minimum value.

Figure 15:
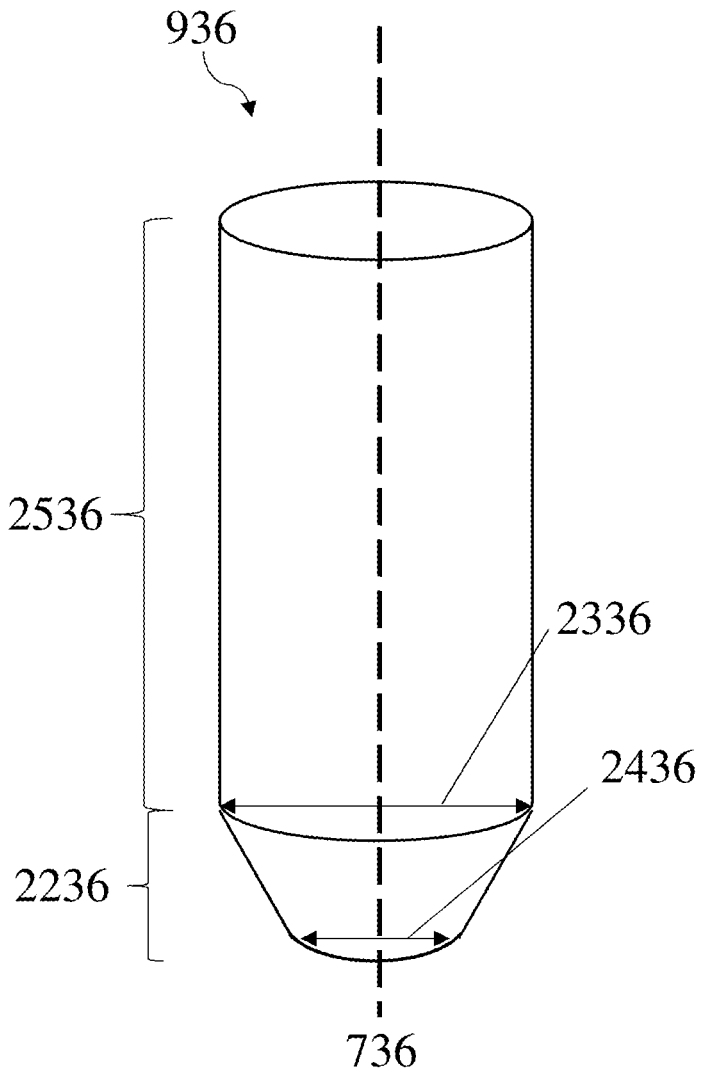
FIG. 15 shows a fluidic reservoir comprising a lower portion that has a cross-sectional diameter that tapers from an upper, maximum value to a lower, minimum value, in accordance with some embodiments.

FIG. 15 is a schematic depiction of a fluidic reservoir comprising a lower portion that has a cross-sectional diameter that tapers from an upper, maximum value to a lower, minimum value. In FIG. 15, the cross-sectional diameter of the lower portion 2236 of the fluidic reservoir 936 tapers from an upper, maximum value 2336 to a lower, minimum value 2436. The tapering shown in FIG. 15 does not occur across the entirety of the vertical axis 736 of the fluidic reservoir but is instead restricted to the lower portion 2236 thereof. Some fluidic reservoirs may have a design similar to FIG. 15 in that their cross-sectional diameters taper from an upper, maximum value to a lower, minimum value across a portion thereof but which also comprise further portions in which the cross-sectional diameter is relatively constant (e.g., similar to the portion 2536 in FIG. 15). It should be understood that it is also possible for a fluidic reservoir to have a design in which the cross-sectional diameter tapers across the entirety thereof (e.g., from an upper surface thereof to a lower surface thereof) or for a fluidic reservoir to comprise a variation in diameter from an upper value (e.g., a maximum value) to a lower value (e.g., a minimum value) that is not tapered.

It should be understood that fluidic reservoirs having other similarities and differences from the fluidic reservoir shown schematically in FIG. 15 are also contemplated. By way of example, in some embodiments, a fluidic reservoir has a cross-section that is a conic section (e.g., a circle, an oval) and/or for which the relative dimensions of an upper, untampered portion and a lower, tapered portion are similar to those shown in FIG. 15. As another example, in some embodiments, a fluidic reservoir has a different aspect ratio and/or degree of tapering than those of the fluidic reservoir depicted schematically in FIG. 15.

Figure 16:
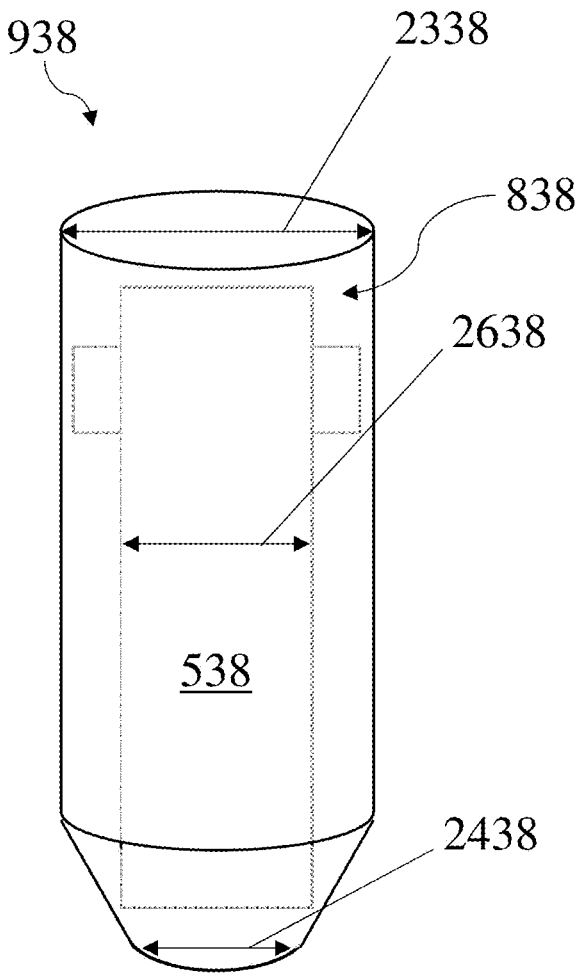
FIGS. 16-17 show fluidic reservoirs in which reagent carriers are positioned, in accordance with some embodiments.

In some embodiments in which a fluidic reservoir comprises a lower portion having a cross-sectional diameter that is less than the cross-sectional diameter of its upper portion, a reagent carrier positioned therein and/or configured to be positioned therein comprises an elongated portion having a cross-sectional diameter that is between the cross-sectional diameter of the lower portion of the fluidic reservoir and the cross-sectional diameter of the upper portion of the fluidic reservoir. Advantageously, this may assist with positioning the reagent carrier at a height within the fluidic reservoir that is consistent and/or provides minimal occlusion to fluids flowing into and/or out of the fluidic reservoir from the bottom thereof. It is also possible for a reagent carrier to comprise an elongated portion having a diameter that is greater than the lower, minimum value of a tapered cross-section of a lower portion of a fluidic reservoir but less than the upper, maximum value thereof. FIG. 16 shows one non-limiting embodiment of a cross-section of a fluidic reservoir 938 in which a reagent carrier 838 is positioned. In FIG. 16, the reagent carrier 838 comprises an elongated portion 538 having a cross-sectional dimension 2638 between the maximum cross-sectional dimension 2338 of the fluidic reservoir 938 and the minimum cross-sectional dimension 2438 of the fluidic reservoir 938.

Figure 17:
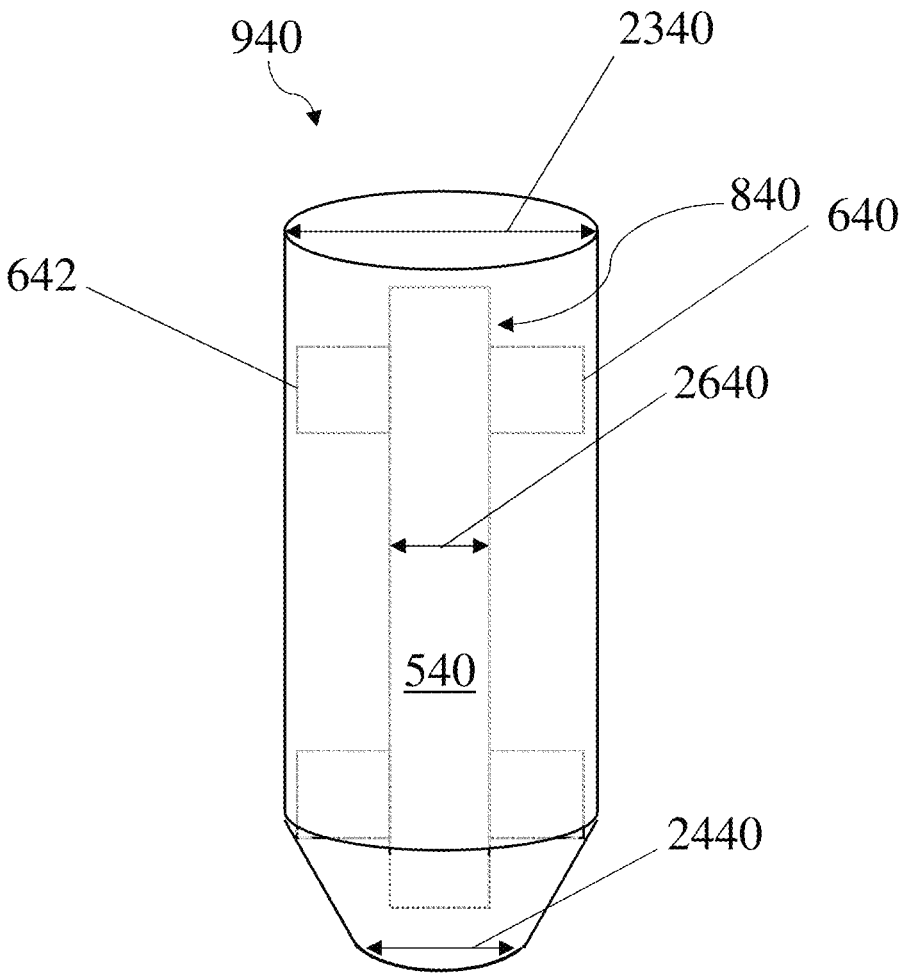

In some embodiments, a fluidic reservoir that comprises a lower portion having a cross-sectional diameter that is less than the cross-sectional diameter of its upper portion (e.g., comprising a tapered cross-section as described above) contains (and/or is configured to contain) a reagent carrier comprising one or more protrusions spanning a width that is between the cross-sectional diameter of the lower portion of the fluidic reservoir and the cross-sectional diameter of the upper portion of the fluidic reservoir. For the same reasons described in the preceding paragraph, such protrusions may assist with positioning the reagent carrier at a height within the fluidic reservoir that is consistent and/or provides minimal occlusion to fluids flowing into and/or out of the fluidic reservoir from the bottom thereof. Such protrusions may be provided in combination with a carrier body having a cross-sectional diameter that is less than the lower, minimum value of a tapered cross-section of a lower portion of a fluidic reservoir. It is also possible for such protrusions to be provided in combination with a carrier body having a cross-sectional diameter that is greater than the lower, minimum value of a tapered cross-section of a lower portion of a fluidic reservoir but less than the upper, maximum value thereof. FIG. 17 shows a schematic depiction of one non-limiting embodiment of a reagent carrier having the former property. In FIG. 17, the reagent carrier 840 comprises an elongated portion 540 having a cross-sectional diameter 2640 less than the minimum cross-sectional dimension 2440 of the fluidic reservoir 940. The reagent carrier further comprises a pair of protrusions 640 and 642 that together span a width between the maximum cross-sectional dimension 2340 of the fluidic reservoir 940 and the minimum cross-sectional dimension 2440 of the fluidic reservoir 940.

It should also be noted that some fluidic reservoirs may have one or more features that assist with the positioning of a reagent carrier therein to be at a desired height and/or to not occlude flow into and/or out of the fluidic reservoir other than the feature shown in FIG. 16. One example of a feature of the fluidic reservoir that may have this property is the presence of an upper surface of the fluidic reservoir that prevents the reagent carrier from extending above a certain point therein. For instance, in some embodiments, a fluidic reservoir is covered by a thin foil, membrane, or other suitable cover to restrict the upwards motion of a reagent carrier positioned therein. The cover may be substantially permeable to some or all fluids (e.g., air, one or more liquids introduced into the fluidic reservoir), and/or may be substantially impermeable to some or all fluids (e.g., air, one or more liquids introduced into the fluidic reservoir). In some embodiments, the cover is substantially permeable to gases but not to liquids. Some covers may be permeable to gases supplied at a certain pressure but not to liquids supplied at that same pressure. Some suitable covers are hydrophobic and some suitable covers are hydrophilic.

As another example, in some embodiments, a reagent carrier is formed from a material or combination of materials that have a density in excess of the density of one or more (or all) of the liquids introduced into the reagent carrier during use of the fluidic device. In such embodiments, the reagent carrier may remain at the bottom of the fluidic reservoir (or at the lowest portion into which it can fit) when the fluidic device is operated. For instance, in some embodiments, a reagent carrier may, as a whole, be denser than water (e.g., may have a density of greater than 1 g/cm$^3$). Non-limiting examples suitable types of material that may be used to form a reagent carrier are polymers (e.g., acetals, ABS, cellulose acetate, cellulose diacetate, polyamides, polybutylene terephthalate, polycarbonates, polyacrylates, polyethylene, polyetheretherketone, polyetherimide, polyethersulfone, polyethylene terephthalate, perfluoroalkoxy, polylactide, polymethylmethacrylate/acrylic, polysulfone, polytetrafluoroethylene, polyvinyl chloride), metals (e.g., aluminum), glasses, ceramics, and carbides.

As described elsewhere herein, in some embodiments, a fluidic reservoir constrains a reagent carrier positioned therein such that the reagent carrier's elongated axis forms a relatively low angle with the vertical axis of the fluidic reservoir. In some embodiments, the fluidic reservoir constrains the reagent carrier such that the elongated axis forms an angle of 30° or less, 25° or less, 20° or less, 15° or less, 10° or less, 7.5° or less, 5° or less, 2° or less, or 1° or less with the vertical axis of the fluidic reservoir. In some embodiments, the fluidic reservoir constrains the reagent carrier such that the elongated axis forms an angle of 0° or greater, 1° or greater, 2° or greater, 5° or greater, 7.5° or greater, 10° or greater, 15° or greater, 20° or greater, or 25° or greater with the vertical axis of the fluidic reservoir. Combinations of the above-referenced ranges are also possible (e.g., 30° or less and 0° or greater). Other ranges are also possible. When a fluidic system comprises two or more fluidic reservoirs that each constrain a reagent carrier, each fluidic reservoir may independently constrain the reagent carrier such that it forms an angle with the vertical axis of the fluidic reservoir in which it is positioned in one or more of the ranges described above.

Some fluidic reservoirs may be configured to be initially sealed (e.g., hermetically) from an atmosphere external thereto prior to use of a fluidic device in which they are positioned. By way of example, and as described elsewhere herein, in some embodiments, a fluidic reservoir is hermetically sealed from an atmosphere external to the fluidic device by a thin foil, membrane, or other suitable cover positioned across the top of the fluidic reservoir. In such cases, when it is desirable for a fluid to be capable of escaping out of the top of the fluidic reservoir during operation of the fluidic device, the thin foil or cover may be pierced or removed prior to use of the fluidic device. The fluidic reservoir may be in fluidic communication with one or more channels of the fluidic system that, themselves, are also hermetically sealed from an atmosphere external to the fluidic system by a valve. This valve may be opened prior to use of the fluidic device (e.g., to allow one or more liquids to be introduced thereinto).

The fluidic reservoirs described herein may have a variety of suitable volumes. In some embodiments, a fluidic reservoir has a volume of greater than or equal to 0.1 mL, greater than or equal to 0.2 mL, greater than or equal to 0.3 mL, greater than or equal to 0.4 mL, greater than or equal to 0.5 mL, greater than or equal to 0.75 mL, greater than or equal to 1 mL, greater than or equal to 1.5 mL, greater than or equal to 2 mL, greater than or equal to 2.5 mL, greater than or equal to 3 mL, greater than or equal to 4 mL, greater than or equal to 5 mL, greater than or equal to 6 mL, greater than or equal to 8 mL, greater than or equal to 10 mL, greater than or equal to 15 mL, or greater than or equal to 20 mL. In some embodiments, a fluidic reservoir has a volume of less than or equal to 20 mL, less than or equal to 15 mL, less than or equal to 10 mL, less than or equal to 8 mL, less than or equal to 6 mL, less than or equal to 5 mL, less than or equal to 4 mL, less than or equal to 3 mL, less than or equal to 2.5 mL, less than or equal to 2 mL, less than or equal to 1.5 mL, less than or equal to 1 mL, less than or equal to 0.75 mL, less than or equal to 0.5 mL, less than or equal to 0.4 mL, less than or equal to 0.3 mL, less than or equal to 0.2 mL, or less than or equal to 0.1 mL. Combinations of the above-referenced ranges are also possible (e.g., greater than or equal to 0.1 mL and less than or equal to 20 mL). Other ranges are also possible. When a fluidic system comprises two or more fluidic reservoirs, each fluidic reservoir may independently have a volume in one or more of the ranges described above.

It should be understood that the fluidic systems described herein may be suited for a variety of different applications. In some embodiments, the fluidic system is disposable and/or configured for a single use. Such fluidic systems may be particularly beneficial for diagnostic applications and/or applications comprising analyzing samples of biological origin.

As described elsewhere herein, some embodiments relate to methods that may be performed in conjunction with the reagent carriers, fluidic reservoirs, and/or fluidic devices described herein. Further details regarding such methods are provided below.

As described above, in some embodiments, a method comprises exposing a reagent disposed on a reagent carrier and/or contained in a well therein to one or more liquids. A variety of suitable liquids may be employed for this purpose. For instance, in some embodiments, a liquid to which a reagent is exposed comprises water (i.e., it is an aqueous liquid). It is also possible for the liquid to comprise one or more further species suspended and/or dissolved therein (e.g., biological molecules, such as DNA, RNA, nucleic acids, proteins, fatty acids, and/or sugars, some or all of which may optionally be of human origin; buffering agents; salts; cells; pathogens; lysis agents; etc.). In some embodiments, a liquid to which a reagent is exposed is and/or comprises a specimen (e.g., a fluid to be analyzed in the fluidic device). Non-limiting examples of such liquids include liquids comprising cells (e.g., lysed cells), pathogens, bodily fluids (e.g., urine; blood, such as whole-blood), and/or bodily secretions (e.g., sputum).

When an object comprising a reagent (e.g., a film, such as a liquid film; a pellet) is exposed to a liquid, a variety of suitable amounts of the reagent may be dissolved and/or suspended thereby. In some embodiments, a liquid to which the object comprising the reagent is exposed dissolves and/or suspends greater than or equal to 10 wt %, greater than or equal to 15 wt %, greater than or equal to 20 wt %, greater than or equal to 25 wt %, greater than or equal to 30 wt %, greater than or equal to 40 wt %, greater than or equal to 50 wt %, greater than or equal to 75 wt %, greater than or equal to 90 wt %, greater than or equal to 95 wt %, greater than or equal to 97.5 wt %, greater than or equal to 99 wt %, or greater than or equal to 99.9 wt % of the reagent therein. In some embodiments, a liquid to which the object comprising the reagent is exposed dissolves and/or suspends less than or equal to 100 wt %, less than or equal to 99.9 wt %, less than or equal to 99 wt %, less than or equal to 97.5 wt %, less than or equal to 95 wt %, less than or equal to 90 wt %, less than or equal to 75 wt %, less than or equal to 50 wt %, less than or equal to 40 wt %, less than or equal to 30 wt %, less than or equal to 25 wt %, less than or equal to 20 wt %, or less than or equal to 15 wt % of the reagent therein. Combinations of the above-referenced ranges are also possible (e.g., greater than or equal to 10 wt % and less than or equal to 100 wt %). Other ranges are also possible.

The above-referenced ranges may independently refer to the amount of a reagent that is dissolved in a liquid, the amount of a reagent that is suspended in a liquid, and/or the amount of reagent that is either dissolved or suspended in a liquid. It should be understood that the ranges above may refer to amounts of a reagent that are dissolved, suspended, and/or both dissolved and suspended in a first liquid, a second liquid, or any liquid to which the reagent is exposed. It should also be understood that, for objects comprising two or more reagents, each reagent in the object may independently be described by the ranges described above and/or all of the reagents in the object together may be described by the ranges described above. Similarly, if two or more objects are exposed to a liquid, the amount of reagent suspended and/or dissolved from each object may independently be described by one or more of the ranges described above.

In some embodiments, a liquid to which a reagent disposed on a reagent carrier and/or contained in a well therein is exposed comprises a reagent prior to such exposure. This reagent initially present in the liquid may be a second, different reagent than the reagent disposed on the reagent carrier and/or contained in a well that is positioned in the reagent carrier. The reagent initially present in the liquid may be configured to react with the reagent to which it is exposed. For instance, in some embodiments, a reagent initially present in a liquid may be configured to activate at least a portion of a reagent initially associated with a reagent carrier. This activation may occur upon exposure of the reagent initially associated with the reagent carrier to the reagent initially present in the liquid (e.g., when the reagent initially associated with the reagent carrier is suspended and/or dissolved in the liquid also comprising the other reagent, when the reagent initially associated with the reagent carrier is contacted by the liquid also comprising the other reagent). In some embodiments, a single liquid may be configured to both release a reagent (e.g., dissolve and/or suspend it) and activate the reagent.

Activation of a reagent may comprise transforming a reagent from a first state in which it is relatively unreactive with one or more species to a second state in which it is relatively reactive with the one or more species. Activation may include a variety of suitable processes, including charging (e.g., electrically) the first reagent (e.g., partially, completely). Charging a reagent may comprise performing an acid-base reaction that results in the addition of or removal of, for example, a proton that causes an initially-uncharged reagent to become charged (in the case of complete charging, the reaction may comprise causing the reagent to accept all protons possible and/or release all protons possible). Reagents comprising acidic functional groups may be activated upon exposure to a deprotonated species having a conjugated acid with a $pK_a$ greater than that of the acidic functional groups (e.g., a base) and reagents comprising basic functional groups may be activated upon exposure to protonated species with a $pK_a$ less than that of the basic functional groups (e.g., an acid). Two examples of reagents that may be charged include those comprising carboxylic acid functional groups (that may be deprotonated to form a carboxylate anion) and those comprising amine functional groups (that may be protonated to form a protonated amino cation). One example of a suitable reagent comprising an amine functional group is diethylaminoethyl. Diethylaminoethyl has a $pK_a$ of 7.8, and so may be activated by exposure to a protonated species having a $pK_a$ of less than 7.8.

As one specific example of a reagent that may be activated, in some embodiments, an anion exchanger is activated. The anion exchanger may be conjugated to a particle, such as a magnetic particle.

The period of time over which activation is performed may be relatively short. For instance, in some embodiments, a liquid configured to activate a reagent is exposed to the reagent (and/or present in a fluidic reservoir in which the reagent is also positioned) for a period of time of at most a few minutes, tens of seconds, or a few seconds.

As described above, a reagent may be retained for a period of time after activation within fluidic reservoir in which it is activated. The period of time may comprise a period of time in which a second liquid is subsequently introduced into the fluidic reservoir. For instance, a first liquid to which the reagent carrier is exposed may be configured to activate at least a portion of the reagents disposed thereon and/or contained in a well therein and the second liquid may be a liquid configured to be analyzed by the fluidic device. The reagent(s) activated by the first liquid may be configured to be exposed, in their activated form, to the liquid configured to be analyzed by the fluidic device. The liquid configured to be analyzed by the fluidic device may react with the activated reagent(s) (and, possibly further reagents released from the reagent carrier by the first liquid and/or the second liquid).

When a reagent is retained in a fluidic reservoir after activation therein, the liquid employed to activate the reagent may also be retained in the fluidic reservoir (in whole or in part) or may be removed from the fluidic reservoir. In the former case, the second liquid (e.g., the liquid configured to react with the activated reagent, the liquid configured to be analyzed by the fluidic device) may simply be added to the fluidic reservoir already containing the first liquid and the activated reagent. In the latter case, in some embodiments, one or more procedures are employed to retain a portion or all of the activated reagent in the fluidic reservoir during removal of the first fluid therefrom. By way of example, and as described above, a field may be applied to the fluidic reservoir to retain the activated reagent therein. For instance, in the case of an activated reagent comprising magnetic particles, a magnetic field may be applied to the fluidic reservoir to retain the magnetic particles therein.

In some embodiments, a reaction between activated reagent(s) and a liquid configured to be analyzed by the fluidic device may be a reaction in which at least a portion of a species initially present in the second liquid is captured by the activated reagent(s) (and/or further reagents released from the reagent carrier by the first liquid and/or the second liquid). Such capture may comprise a reaction between the species (e.g., an acid-base reaction, an ion exchange reaction) and the reagent such that the species becomes bound to the reagent. Capture may serve to remove species (in some embodiments, at least partially, substantially fully, or fully) from the second liquid. For instance, the reaction product between the species and the activated reagent may be configured to be retained in a fluidic reservoir in which the capture takes place upon removal of the second liquid therefrom. This may be advantageous when the captured species is one that might interfere with one further analysis of the second liquid. By way of example, such capture may serve to remove components present in relatively large amounts that may overwhelm the signal from components present in relatively smaller amounts during further analysis of the second liquid (e.g., signal from human cells in blood further comprising a relatively small amount of pathogen cells to be detected by and/or within the fluidic device). It is also possible for a reaction between the second liquid and an activated species to produce a detectable signal indicative of one or more features of the second liquid (e.g., the presence and/or amount of a pathogen therein).

It should be noted that, in some embodiments, a component of a second liquid is captured by a reagent that has not been activated. For instance, in some embodiments, a component of a second liquid is captured by a reagent that has been dissolved and/or suspended in a first liquid, but not activated by either the first liquid or the second liquid. As another example, in some embodiments, a component of a second liquid is captured by a reagent that has also been dissolved and/or suspended in the second liquid but activated by either the first liquid or the second liquid. It should also be noted that a component of a second liquid may be captured by a reagent that has been activated by the second liquid. By way of example, a second liquid may both activate a reagent that is exposed to the second liquid (e.g., upon exposure) and be captured by that reagent after it activates it. Species that may be captured (e.g., by an activated reagent) include biological molecules. For instance, in some embodiments nucleic acids and/or biological molecules (e.g., eukaryote DNA, human DNA, microbial DNA, prokaryote DNA, RNA, nucleic acids, proteins, fatty acids, sugars) are captured.

A variety of suitable amounts of a species in a second liquid may be captured by a reagent (e.g., a reagent activated by a first liquid). In some embodiments, greater than or equal to 10 wt %, greater than or equal to 15 wt %, greater than or equal to 20 wt %, greater than or equal to 25 wt %, greater than or equal to 30 wt %, greater than or equal to 40 wt %, greater than or equal to 50 wt %, greater than or equal to 75 wt %, greater than or equal to 90 wt %, greater than or equal to 95 wt %, greater than or equal to 97.5 wt %, greater than or equal to 99 wt %, greater than or equal to 99.9 wt %, greater than or equal to 99.95 wt %, or greater than or equal to 99.99 wt % of a species is captured by a reagent. In some embodiments, less than or equal to 100 wt %, less than or equal to 99.99 wt %, less than or equal to 99.95 wt %, less than or equal to 99.9 wt %, less than or equal to 99 wt %, less than or equal to 97.5 wt %, less than or equal to 95 wt %, less than or equal to 90 wt %, less than or equal to 75 wt %, less than or equal to 50 wt %, less than or equal to 40 wt %, less than or equal to 30 wt %, less than or equal to 25 wt %, less than or equal to 20 wt %, or less than or equal to 15 wt % of a species is captured by a reagent. Combinations of the above-referenced ranges are also possible (e.g., greater than or equal to 10 wt % and less than or equal to 100 wt %). Other ranges are also possible.

When a second liquid comprises two or species captured by a reagent (e.g., a reagent activated by a first liquid), each species may independently be captured by the reagent in one or more of the ranges described above. Similarly, when a second liquid comprises a species that is captured by two or more reagents (e.g., two or more reagents activated by the first liquid), each reagent may independently capture an amount of the species in one or more of the ranges described above and/or all of the reagents together may capture an amount of the species in one or more of the ranges described above.

Some methods may comprise removing DNA from eukaryotes from a specimen, such as a specimen further comprising DNA from a non-eukaryote pathogen. Such methods are further described in International Patent Publication No. WO 2017/160820, International Patent Publication No. WO 2016/044621, and International Application No. PCT/US2018/25681, each of which is incorporated herein by reference in its entirety for all purposes. Briefly, a method of removing eukaryote DNA from a specimen may comprise selectively lysing the eukaryote cells in the specimen and then capturing any free eukaryote DNA present in the resultant specimen (e.g., DNA from the lysed cells, DNA freely circulating in the specimen prior to eukaryote cell lysis). This may occur in a fluidic reservoir from which the specimen is subsequently removed. The DNA captured may be retained in the fluidic reservoir. For instance, in some embodiments, the DNA may be captured by a reagent (e.g., an anion exchanger) conjugated to a magnetic bead that is retained in the fluidic reservoir upon application of a magnetic field thereto. Without wishing to be bound by any particular theory, in some embodiments, it may be desirable to remove an appreciable fraction or all of the eukaryote DNA in a specimen for which it is desirable to determine the amount of prokaryote DNA therein. The eukaryote DNA may be present in the specimen in a much higher amount than the prokaryote DNA and may overwhelm the signal from the prokaryote DNA in the specimen if not removed therefrom.

The reagent carrier shown schematically in FIGS. 8B-8C may be particularly well-suited for methods comprising the removal of DNA from eukaryotes from a specimen. In such embodiments, the lower well may contain a reagent that takes the form of a plurality of magnetic beads configured to be activated upon exposure to a first liquid, and, after activation, to capture DNA to which they are exposed. The upper well may contain a buffering agent and/or a defoaming agent. In some embodiments, the reagents positioned in the lower and/or upper wells may take the form of solid particles present in a liquid film. This reagent carrier may be positioned in (and, possibly constrained by) a fluidic reservoir.

When the reagent carrier shown schematically in FIGS. 8B-8C is employed to remove eukaryote DNA from a specimen, an activation solution may be introduced into the fluidic reservoir as the first liquid in an amount such that the magnetic beads configured to be activated are released from the lower well into the first liquid and then incubated in the first liquid for a period of time of several seconds to several minutes. After activation, the activated magnetic beads may be retained in the fluidic reservoir by a magnetic field. This may occur concurrently with the removal of the first liquid from the fluidic reservoir or with the retention of the first liquid in the fluidic reservoir. Then, a second liquid may be introduced into the fluidic reservoir in an amount sufficient to release the contents of the upper well into the second liquid. The second liquid may be a specimen and/or a specimen mixed with a lysis agent. After exposure of the activated magnetic beads to the second liquid, the second liquid, too, may be removed from the fluidic reservoir while the activated magnetic beads are again retained in the fluidic reservoir by a magnetic field. Any eukaryote DNA present in the specimen and captured by the activated magnetic beads may also be retained in the fluidic reservoir. This process may result in the formation of a specimen substantially depleted of any eukaryote DNA initially present therein, which may be further analyzed in the fluidic device (e.g., for non-eukaryote DNA, for pathogen DNA).

It should also be noted that some methods suitable for removing eukaryote DNA from a specimen may comprise passing the specimen sequentially through two or more (e.g., three) fluidic reservoirs, each of which comprise a reagent carrier having a design similar to that shown in FIGS. 8B-8C. The bottom well of each such reagent carrier may comprise magnetic beads configured to be activated. The contents of the top wells of these reagent carriers may each differ from the other reagent carriers.

The reagent carrier shown schematically in FIGS. 8D-8E may be particularly well-suited for methods comprising lysis of microbial cells. Such methods are further described in International Patent Publication No. WO 2017/160820, International Patent Publication No. WO 2016/044621, and International Application No. PCT/US2018/25681. When a reagent carrier having a design similar to that shown in FIGS. 8D-8E is employed to perform such a method, the liquid comprising the microbial cells to be lysed may be simultaneously reacted with two or more reagents for which dry storage is preferable and that should not be stored together. These two or more reagents may be stored on a single reagent carrier in separate wells. With reference to FIG. 8D, a reagent carrier suitable for use in a method of lysing microbial cells may be configured to contain a lyophilized pellet in well 1 and to contain liquid films comprising solid reagents in wells 2-5. It is also possible for a reagent carrier suitable for use in a method of lysing microbial cells to comprise an empty well 1 (i.e., lacking any reagent, pellet, or liquid film) and to contain liquid films comprising solid reagents in wells 2-5. A reagent carrier having the structure shown in FIGS. 8D-8E and configured to be employed in a method of lysing microbial cells may be positioned in (and, possibly constrained by) a fluidic reservoir.

Lysis of microbial cells may be accomplished by introducing a first liquid comprising microbial cells into a fluidic reservoir containing a reagent carrier having a structure similar to that shown in FIGS. 8D-8E. The first liquid may be introduced into the fluidic reservoir in an amount such that the reagents in all of wells 1-5 are exposed thereto and released thereinto. In some embodiments, the first liquid is then retained in the fluidic reservoir until it has reacted to an appreciable degree (e.g., to a high yield) with the reagents initially contained in the wells 1-5. The first liquid may then be removed from the fluidic reservoir. In some embodiments, the first liquid is then introduced into a second fluidic reservoir also containing a reagent carrier having a structure similar to that shown in FIGS. 8D-8E. The first fluidic reservoir may comprise a combination of reagents configured to perform an enzymatic lysis step or a detergent lysis step, and the second fluidic reservoir may comprise a combination of reagents configured to perform the other of the enzymatic lysis step and the detergent lysis step. The fluidic reservoir comprising a combination of reagents configured to perform an enzymatic lysis step may contain a pellet comprising lyophilized enzymes in well 1. The fluidic reservoir comprising a combination of reagents configured to perform an enzymatic lysis step may comprise an empty well 1. Wells 2-5 in such reagent carriers may comprise buffering agents, surfactants, and/or defoaming agents.

It should be noted that a reagent carrier having a design similar to that shown in FIGS. 8F-8G may also be suitable for use in a method of lysing microbial cells. In such embodiments, any pellets contained in the reagent carrier may be held in place by the flap shown in these FIGS.

As described elsewhere herein, some embodiments comprise disposing a reagent on and/or in a well by spotting. Spotting may comprise depositing a spotting liquid comprising the reagent (e.g., suspended and/or dissolved therein) into the well and then allowing the spotting liquid to at least partially (e.g., fully) evaporate. After evaporation of the spotting liquid, the reagent, and further non-volatile species present in the liquid, may be retained in the well in the form of a film disposed thereon. As also described elsewhere herein, in some embodiments, it may be advantageous for the spotting liquid to further comprise a relatively non-volatile liquid, which may promote the formation of a liquid film comprising the reagent in solid form.

When a reagent is deposited in a well (e.g., by spotting, or another method), it may be beneficial to include a diluent in the composition employed for this purpose. As an example, with reference to spotting, in some embodiments, the spotting liquid may be a diluent and/or the composition may further comprise a diluent in addition to the spotting liquid. The diluent may reduce the surface tension of the composition comprising the reagent, thereby making it easier to dispense and/or deposit in the well. This reduced surface tension may also cause the composition to spread more evenly within the well than an otherwise equivalent composition lacking the diluent, thereby promoting the formation of a smooth, even, and/or homogeneous film. Such films may, advantageously, have enhanced surface area and/or have an enhanced area over which they are in contact with the reagent carrier. The former feature may increase the area of the film that may be exposed to a liquid into which it is configured to be released, thereby increasing its rate of release thereinto, may improve the uniformity with which the reagent is released into the liquid, may reduce the tendency of the reagent to form aggregates in the liquid into which it is released, and/or may improve the reliability with which the reagent is released into the liquid. The latter feature may increase the strength of adhesion between the film and the reagent carrier, which may make the film more challenging to delaminate from the reagent carrier. In some embodiments, the diluent may also reduce the surface tension of a film formed from the composition (e.g., when present therein).

Some suitable diluents may be at least partially miscible with and/or dissolve one or more components of the composition being deposited (e.g., any liquids therein, any reagents therein, any species other than reagents therein). For instance, in some embodiments in which the composition comprises one or more species partially or fully miscible with water, the diluent may comprise water.

As described above, it may be desirable for reagents to be positioned in liquid films having relatively high viscosities. In such embodiments, it may be advantageous to remove some or all of any diluent from a composition employed to form the liquid film after formation of the liquid film. This may be accomplished by, for instance, evaporation. Accordingly, in some embodiments, a diluent is employed that is more volatile than the other components of the liquid film (e.g., than any liquids therein, than any reagents therein, than any species other than reagents therein). Evaporation may be assisted by the application of heat to the liquid film and/or the application of reduced pressure to the liquid film.

Example 1

This Example describes the use of a fluidic device to detect the presence of invasive and potentially pathogenic microorganisms in human blood.

Human blood from humans typically includes very high levels of human DNA. Accordingly, tests designed to detect the presence of pathogens in human blood based on the presence of pathogen genetic material may be significantly limited by the large presence of human DNA also present in the human blood. This human DNA may undesirably be inhibitory during enzymatic amplification and/or may cause off-priming effects to occur. The process described in this Example comprises removing human DNA from human blood prior to analysis of the microbial DNA therein, which improves the efficacy of the processes employed to detect and/or characterize of any microbial DNA that may be present.

The fluidic system shown in FIG. 11B was employed to remove the human DNA from the human blood. As shown in FIG. 11B, this fluidic system comprised a plurality of fluidic reservoirs including a first fluidic reservoir (920A) and a second fluidic reservoir (920B). Each fluidic reservoir was in fluidic communication with a fluidic channel by an opening positioned at its bottom and further comprised an opening positioned at its top. These openings were sealed during storage. During use of the fluidic device, the openings were in fluidic communication with valves that were configured to place the fluidic reservoirs in fluidic communication with an atmosphere external to the fluidic device, with a source of pressure (held at a pressure either higher or lower than atmospheric pressure), or to seal the fluidic reservoirs. The second fluidic reservoir contained a reagent carrier having the design shown in FIG. 8B. The reagent carrier's upper well comprised a defoaming agent (Sigma Y-30) and the reagent carrier's lower well comprised a plurality of magnetic particles each having a diameter of between about 0.5 microns and about 1.5 microns and conjugated to a weak anion exchanger comprising a tertiary amine group. The plurality of magnetic particles were positioned in a film further comprising a low molecular weight polyol. This film was formed by deposition from a water-based solution from which the water was subsequently removed by evaporation. The system, as a whole, was configured for a single use.

A fresh whole-blood sample attained from a recent venous blood draw was introduced into this system by transferring it aseptically to the first fluidic reservoir. Then, a solution comprising two different non-ionic surfactants in roughly equal amounts was introduced into the first fluidic reservoir through the opening positioned at its bottom. This solution acted as a selective lysis solution and is described in further detail in WO 2016/044621. After introduction of the selective lysis solution, air bubbles were introduced into the first fluidic reservoir through the opening positioned at its bottom, which, while flowing upwards and then out the open top of the first fluidic reservoir (and then through the open valve in fluidic communication with the open top of the first fluidic reservoir into the atmosphere external to the fluidic device), caused the selective lysis solution and the blood sample to mix. Upon mixing of these two liquids, substantially all of the eukaryotic cells in the blood sample were lysed, releasing the human DNA therein. Such eukaryotic cells included the human cells in the sample, such as the white blood cells therein. The selective lysis solution was selected to not cause appreciable lysis of any microbial cells present in the whole-blood sample.

While the whole-blood sample was positioned in the first fluidic reservoir, an activation solution was introduced to the second fluidic reservoir from the opening positioned at its bottom. The activation solution had a pH of below about 7.5 and had a volume sufficient to suspend the magnetic particles positioned in the lower well of the reagent carrier contained in the second fluidic reservoir but insufficient to expose the defoaming agent positioned in the lower well of this reagent carrier thereto. This activation solution was allowed to activate the anion exchanger for a few seconds. After activation of the anion exchanger, the activation solution was removed from the second fluidic reservoir by application of pressurized air to the second fluidic reservoir through the valve positioned at its top. The pressurized air caused the activation solution to flow out of the opening positioned at the bottom of the second fluidic reservoir into a fluidic channel in fluidic communication therewith. This activation solution then flowed into a third fluidic reservoir. During the removal of the activation solution, a magnetic field was applied to the second fluidic reservoir to retain the magnetic particles therein.

After removal of the activation solution, the treated whole-blood sample was removed from the first fluidic reservoir in the same manner that the activation solution was removed from the second fluidic reservoir. It was subsequently transferred through a fluidic channel connecting the first and second fluidic reservoirs and then be introduced into the second fluidic reservoir from the opening at the bottom of the second fluidic reservoir. As the treated whole-blood sample was introduced into the second fluidic reservoir, air in the second fluidic reservoir flowed out of its open top, through the open valve in fluidic communication with the open top of the second fluidic reservoir into the atmosphere external to the fluidic device.

The treated whole-blood sample resuspended the magnetic particles. The treated whole-blood sample also exposed the defoaming agent thereto and suspended the defoaming agent therein. After these processes, air bubbles were passed through the second fluidic reservoir in the same manner described previously for the air bubbles in the first fluidic reservoir. During the mixing caused by the air bubbles, the free human DNA in the treated whole-blood sample was captured by the magnetic particles via the activated anion exchanger. The total time over which the treated whole-blood sample is introduced into the second fluidic reservoir and mixed with the magnetic beads was less than five minutes. After this time period, the treated whole-blood sample was removed from the second fluidic reservoir by the same process described previously for the activation solution.

A magnetic field was applied to the second fluidic reservoir during removal of the blood sample to retain the magnetic beads by the same process described previously for the activation solution. After the treated whole-blood sample was removed from the second fluidic reservoir, it contained an amount of human DNA that was substantially less than the amount it contained prior to being introduced into the second fluidic reservoir (roughly 5% of the human DNA initially present in the whole blood sample).

The whole-blood sample was then be passed through additional fluidic reservoirs identical to the second fluidic reservoir employing the same process described in the preceding paragraphs. After these steps, the whole-blood sample included less than 0.02% of the human DNA initially present in the whole-blood sample.

Figure 18:
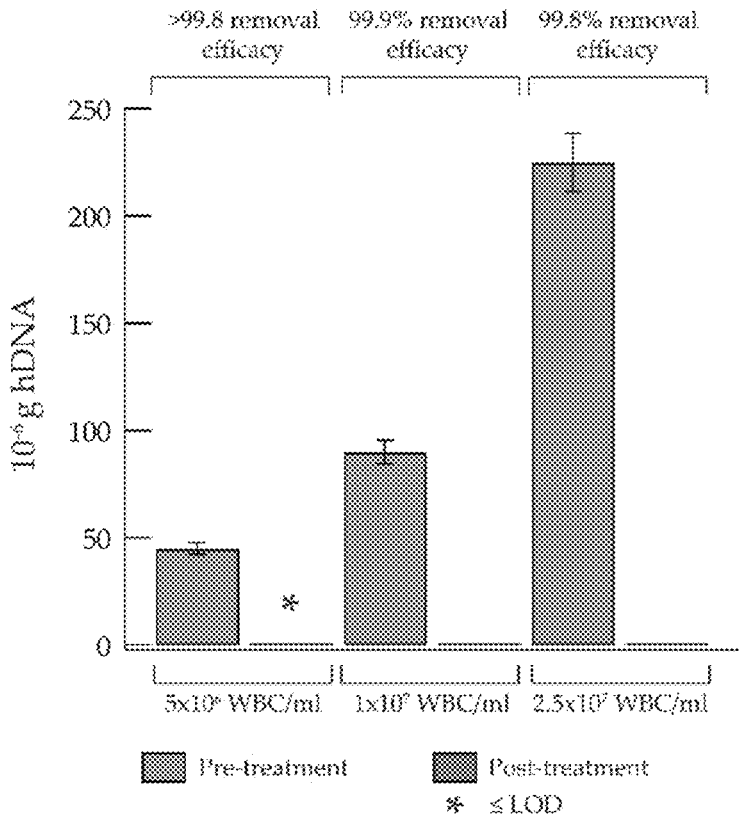
FIG. 18 shows data obtained from exemplary fluidic systems as described in Example 1, in accordance with some embodiments.

FIG. 18 shows data obtained by performing the procedure described above for blood samples having three different white blood cell loads ($5*10^6$ white blood cells per mL, $1*10^7$ white blood cells per mL, and $2.5*10^7$ white blood cells per mL). Fifteen samples, each having a volume of 1.5 mL, were used for each white blood cell load, each of which was passed through its own single-use device. The data shown in FIG. 18 is an average of these fifteen samples. As can be seen from FIG. 18, ~99.9% of the human DNA initially present. The error bars show the standard deviation.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A fluidic system, comprising:

a fluidic reservoir comprising a vertical axis;

a reagent carrier positioned in the fluidic reservoir, wherein:

the reagent carrier comprises a carrier body comprising an elongated portion extending along an elongated axis and one or more protrusions extending from the elongated portion, and the fluidic reservoir constrains the reagent carrier such that the elongated axis forms an angle of 30° or less with the vertical axis of the fluidic reservoir.

2. A fluidic system as in claim 1, wherein a length of the elongated portion is greater than or equal to 50% of a height of the fluidic reservoir and less than or equal to 100% of the height of the fluidic reservoir.

3. A fluidic system as in claim 1, wherein a portion of the carrier body having the maximum width of the reagent carrier is proximate to an upper portion of the carrier body.

4. A fluidic system as in claim 1, wherein the carrier body comprises two straight portions protruding from the elongated portion that form a 90° angle with the elongated portion and a 180° angle with each other.

5. A fluidic system as in claim 1, wherein the fluidic reservoir comprises a lower portion that has a cross-sectional diameter that tapers from an upper, maximum value to a lower, minimum value, and wherein a cross-sectional diameter of the elongated portion is greater than the lower, minimum value.

6. A fluidic system as in claim 1, wherein the reagent carrier is positioned in the fluidic reservoir such that flow of liquid into and/or out of the fluidic reservoir is not occluded.

7. A fluidic system as in claim 1, wherein the reagent carrier is separable from the fluidic reservoir.

8. A fluidic system as in claim 1, wherein the carrier body comprises two wells positioned at different locations along the elongated section of the reagent carrier.

9. A fluidic system as in claim 1, wherein the carrier body comprises two wells positioned beside each other at the same length along the elongated section of the reagent carrier.

10. A fluidic system as in claim 8, wherein one of the wells has a volume of greater than or equal to 1 microliter and less than or equal to 1000 microliters.

11. A fluidic system as in claim 8, wherein the carrier body comprises a portion configured to retain a pellet in one of the two wells, and wherein the portion forms a flap that can be closed.

12. A fluidic system as in claim 8, wherein at least one of the wells is configured to be empty.

13. A fluidic system as in claim 1, wherein a liquid film is disposed on at least a portion of the carrier body, wherein the liquid film comprises a solid reagent, and wherein at least a portion of the film is soluble in water.

14. A fluidic system as in claim 13, wherein the solid reagent comprises particles soluble and/or suspendable in water.

15. A fluidic system as in claim 14, wherein the particles are magnetic.

16. A fluidic system as in claim 13, wherein the solid reagent comprises beads.

* * * * *